US008146766B2

(12) United States Patent
Vovan et al.

(10) Patent No.: US 8,146,766 B2
(45) Date of Patent: Apr. 3, 2012

(54) ENHANCED SECURE CONTAINER

(75) Inventors: Terry Vovan, Upland, CA (US); Jimmy Pho, Los Angeles, CA (US); Lauren Yee, West Bloomfield, MI (US); Leon D. Rosen, Santa Monica, CA (US)

(73) Assignee: PWP Industries, Vernon, CA (US)

( * ) Notice: Subject to any disclaimer, the term of this patent is extended or adjusted under 35 U.S.C. 154(b) by 0 days.

(21) Appl. No.: 12/432,627

(22) Filed: Apr. 29, 2009

(65) Prior Publication Data

US 2010/0276422 A1 Nov. 4, 2010

(51) Int. Cl.
*B65D 17/50* (2006.01)

(52) U.S. Cl. ..... 220/260; 220/212; 220/520; 220/574; 220/574.1

(58) Field of Classification Search ..... 220/256.1, 220/260, 520, 574, 574.1, 212
See application file for complete search history.

(56) References Cited

U.S. PATENT DOCUMENTS

| | | | |
|---|---|---|---|
| 1,988,280 | A | 1/1935 | Levkoff |
| 2,567,013 | A | 9/1951 | Feinberg, Charles E. |
| 2,701,053 | A | 2/1955 | Tamarin |
| 3,572,579 | A | 3/1971 | Mueller |
| 3,773,207 | A | 11/1973 | Dokoupil et al. |
| 3,860,148 | A | 1/1975 | Sherin |
| 3,933,296 | A | 1/1976 | Ruskin et al. |
| 3,941,248 | A | 3/1976 | Moser et al. |
| 3,955,742 | A | 5/1976 | Marshall et al. |
| 3,984,025 | A | 10/1976 | Khoury |
| 4,060,176 | A | 11/1977 | Tobiasson |
| 4,113,136 | A | 9/1978 | Abbott |
| 4,139,121 | A | 2/1979 | Roccaforte |
| 4,262,814 | A | 4/1981 | Roccaforte |
| 4,520,943 | A | 6/1985 | Nielsen |
| 4,555,043 | A | 11/1985 | Bernhardt |
| 4,560,082 | A | 12/1985 | Sutch |
| 4,569,443 | A | 2/1986 | Roccaforte |
| 4,610,371 | A | 9/1986 | Karkiewicz |
| 4,627,550 | A | 12/1986 | Dines |
| 4,671,453 | A | 6/1987 | Cassidy |

(Continued)

FOREIGN PATENT DOCUMENTS

| | | |
|---|---|---|
| DE | 7816353 | 11/1978 |

(Continued)

OTHER PUBLICATIONS

U.S. Appl. No. 11/315,654 filed Dec. 21, 2005.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

A container of sheet plastic reveals when it has been opened after a clerk loaded it with food. The container has a base (12) and lid (14) that remain latched together until they are separated at an initial opening region (40) where the lid has a radially-outward projecting lid tab (44) and the base has a tear-away part (52) with a blocker (60) that blocks access to the lid tab. The blocker surrounds the radially outward edge and opposite sides of the tab. The blocker prevents access to the lid tab to lift it to open the container until the tear-away part (52) is torn along a tear line (81). The fact that the tear-away part is torn away, reveals that the container has been tampered with.

29 Claims, 34 Drawing Sheets

U.S. PATENT DOCUMENTS 4,721,210 A 1/1988 Lawrence et al.
4,742,935 A 5/1988 Schellenberg
4,782,977 A 11/1988 Watanabe et al.
4,785,963 A 11/1988 Magley
4,819,824 A * 4/1989 Longbottom et al. ..... 220/266
4,881,656 A 11/1989 Chumley et al.
4,930,656 A 6/1990 Blanchette
4,966,292 A 10/1990 Marino et al.
4,974,735 A 12/1990 Newell
4,990,345 A 2/1991 Webb
5,002,198 A 3/1991 Smith
5,007,231 A 4/1991 Ingemann
5,027,969 A 7/1991 Lesquir
5,040,695 A 8/1991 Adams et al.
5,052,572 A 10/1991 Pherigo
5,092,479 A 3/1992 Wells
5,111,953 A 5/1992 Faust et al.
5,111,954 A 5/1992 Gaudreault
5,115,934 A 5/1992 Nelson
5,129,531 A 7/1992 Beck et al.
5,131,551 A 7/1992 Wells
5,133,470 A 7/1992 Abrams et al.
5,163,575 A 11/1992 Luch et al.
5,170,905 A 12/1992 Luch
5,219,087 A 6/1993 Christensson
5,249,694 A 10/1993 Nelson
5,251,758 A 10/1993 Kolacek
5,283,940 A 2/1994 Luch et al.
5,300,748 A 4/1994 Colombo
5,303,839 A 4/1994 Blumenschein
5,307,948 A 5/1994 Blackburn et al.
5,437,386 A 8/1995 Von Holdt
5,507,406 A 4/1996 Urciuoli et al.
5,511,679 A 4/1996 Beck
5,528,814 A 6/1996 Luch et al.
5,573,134 A 11/1996 Chenault et al.
5,626,251 A 5/1997 Luburic et al.
5,772,110 A 6/1998 Garretson
5,785,203 A 7/1998 Arshinoff et al.
5,788,105 A 8/1998 Foos
5,871,147 A 2/1999 Smith et al.
5,875,913 A 3/1999 Letica
5,890,648 A 4/1999 Cai
5,931,291 A 8/1999 Sedon et al.
5,931,332 A 8/1999 Mygatt et al.
5,979,690 A 11/1999 Hartley
6,000,570 A 12/1999 Nelson
6,045,038 A 4/2000 Smith et al.
RE36,729 E 6/2000 Luch et al.
6,116,450 A 9/2000 Huang
6,193,921 B1 2/2001 Nelson
6,257,435 B1 7/2001 Chedister et al.
6,279,774 B1 8/2001 Clute et al.
6,328,355 B1 12/2001 Bortz
6,491,164 B1 12/2002 Virvo
6,572,909 B1 6/2003 Bagwell et al.
6,604,645 B1 8/2003 Vaupotic
6,604,646 B2 8/2003 Torniainen et al.
6,877,631 B1 4/2005 Thompson et al.
6,899,245 B1 5/2005 Nelson
7,004,314 B2 2/2006 Pucillo et al.
7,073,680 B2 7/2006 Boback et al.
7,097,043 B2 8/2006 Hsu
7,118,003 B2 10/2006 Sellari et al.
7,140,211 B2 11/2006 Tremblay
7,172,109 B2 2/2007 Kuenstler et al.
7,235,207 B2 6/2007 Gregory et al.
7,311,218 B2 12/2007 Varadarajan
7,325,676 B2 2/2008 Galaz
7,661,547 B2 2/2010 Richir
7,694,837 B2 4/2010 Robertson et al.
7,757,848 B2 7/2010 Gelardi et al.
2002/0088814 A1 7/2002 Belfance
2002/0170914 A1 11/2002 Witt
2003/0029868 A1 2/2003 Davidov et al.
2003/0127419 A1 7/2003 Shenkar et al.
2003/0160051 A1 8/2003 Ciccone
2003/0189048 A1 10/2003 Luburic
2004/0026286 A1 2/2004 Ramsey
2004/0045867 A1 3/2004 Appelbaum
2004/0094548 A1 5/2004 Laveault
2004/0108370 A1 6/2004 Lee
2004/0118848 A1 6/2004 Marshall
2004/0200839 A1 10/2004 Conti
2004/0200891 A1 10/2004 Correll
2005/0017007 A1 1/2005 Sellari et al.
2005/0061861 A1 3/2005 Pennino
2005/0145628 A1 7/2005 Schwarz
2005/0161455 A1 7/2005 Studee
2005/0173435 A1 8/2005 Wellman et al.
2005/0184070 A1 8/2005 Boback et al.
2005/0236413 A1* 10/2005 Maciag et al. ..... 220/256.1
2005/0252916 A1 11/2005 Varadarajan
2006/0003879 A1 1/2006 Buchman
2006/0006178 A1 1/2006 Foldesi et al.
2006/0011632 A1 1/2006 Caille
2006/0016821 A1 1/2006 Liu
2006/0144874 A1 7/2006 Solowiejko
2006/0163265 A1 7/2006 De Candido
2006/0201946 A1 9/2006 Witt
2006/0261070 A1 11/2006 Robertson et al.
2006/0266750 A1 11/2006 Lesquir
2006/0289541 A1 12/2006 Boback et al.
2006/0289549 A1 12/2006 Vovan
2007/0062948 A1 3/2007 Albrecht et al.
2007/0095848 A1 5/2007 Galland et al.
2007/0108210 A1 5/2007 Alvares et al.
2007/0138180 A1 6/2007 Vovan
2007/0164026 A1 7/2007 Morrissey et al.
2007/0202221 A1 8/2007 Hinze et al.
2008/0000904 A1 1/2008 Vovan
2008/0006632 A1 1/2008 Vovan
2008/0185383 A1 8/2008 Philippe et al.
2008/0199108 A1 8/2008 Rogers
2009/0021026 A1 1/2009 Collier
2009/0032545 A1 2/2009 Zeiler et al.
2009/0057313 A1 3/2009 Alvares
2009/0120936 A1 5/2009 Zauser et al.
2009/0120942 A1* 5/2009 Vovan ..... 220/574.1

FOREIGN PATENT DOCUMENTS

DE 4418935 12/1995
DE 29819718 1/1999
DE 29914659 8/1999
EP 0752374 1/1997
EP 1736417 12/2006
FR 2691952 12/1993
FR 2819496 1/2001
GB 2257118 1/1993
WO WO 2005/082733 9/2005
WO WO 2005/082734 9/2005

OTHER PUBLICATIONS

U.S. Appl. No. 11/315,654, Non-Final Rejection dated May 12, 2009.
U.S. Appl. No. 11/315,654, Amendment dated Aug. 10, 2009.
U.S. Appl. No. 11/315,654, Non-Final Rejection dated Nov. 25, 2009.
U.S. Appl. No. 11/315,654, Amendment dated Jan. 20, 2010.
U.S. Appl. No. 11/315,654, Restriction Requirement dated Jun. 25, 2010.
U.S. Appl. No. 11/315,654, Response to Restriction dated Jul. 26, 2010.
U.S. Appl. No. 11/315,654, Final Rejection dated Oct. 19, 2010.
U.S. Appl. No. 11/315,654, Amendment and RCE dated Jan. 19, 2011.
U.S. Appl. No. 12/220,017 filed Jul. 21, 2008.
U.S. Appl. No. 11/857,144 filed Sep. 18, 2007.
U.S. Appl. No. 11/857,144, Non-Final Rejection dated Jan. 7, 2011.
U.S. Appl. No. 11/857,144, Amendment dated Apr. 7, 2011.
U.S. Appl. No. 11/879,168 filed Jul. 16, 2007.
U.S. Appl. No. 11/879,168, Non-Final Rejection dated Jun. 10, 2010.
U.S. Appl. No. 11/879,168, Amendment dated Sep. 14, 2010.
U.S. Appl. No. 11/879,168, Final Rejection dated Dec. 10, 2011.

U.S. Appl. No. 11/879,168, Amendment After Finaldated Mar. 10, 2011.
U.S. Appl. No. 11/879,168, Advisory Action dated Apr. 26, 2011.
U.S. Appl. No. 12/327,759 filed Dec. 3, 2008.
U.S. Appl. No. 12/327,759, Non-Final Rejection dated Jan. 21, 2011.
U.S. Appl. No. 12/327,759, Amendment dated Apr. 21, 2011.
U.S. Appl. No. 12/075,549 filed Mar. 12, 2008.
U.S. Appl. No. 11/879,168, Sep. 27, 2011 Issue Fee paid.
U.S. Appl. No. 12/075,549, Oct. 18, 2011 Response to Non-Final Office Action.
U.S. Appl. No. 12/220,017, Oct. 19, 2011 Non-Final Office Action.
U.S. Appl. No. 11/879,168, Jun. 27, 2011 Notice of Allowance.
U.S. Appl. No. 11/879,168, Jun. 10, 2011 Notice of Appeal.
U.S. Appl. No. 11/879,168, Jun. 9, 2011 Amendment after Final.
U.S. Appl. No. 11/857,144, Sep. 21, 2011 Response to Final Office Action.
U.S. Appl. No. 11/857,144, Jun. 21, 2011 Final Office Action.
U.S. Appl. No. 12/327,759, Aug. 11, 2011 Final Office Action.
U.S. Appl. No. 12/075,549, Jul. 22, 2011 Non-Final Office Action.
U.S. Appl. No. 12/220,017, Jan. 19, 2012 Response to Non-Final Office Action.
U.S. Appl. No. 12/075,549, Jan. 27, 2012 Issue Fee payment.
U.S. Appl. No. 11/857,144, Jan. 19, 2012 Issue Fee payment.
US 0,236,413, 10/2005, Maciag et al. (withdrawn)

* cited by examiner

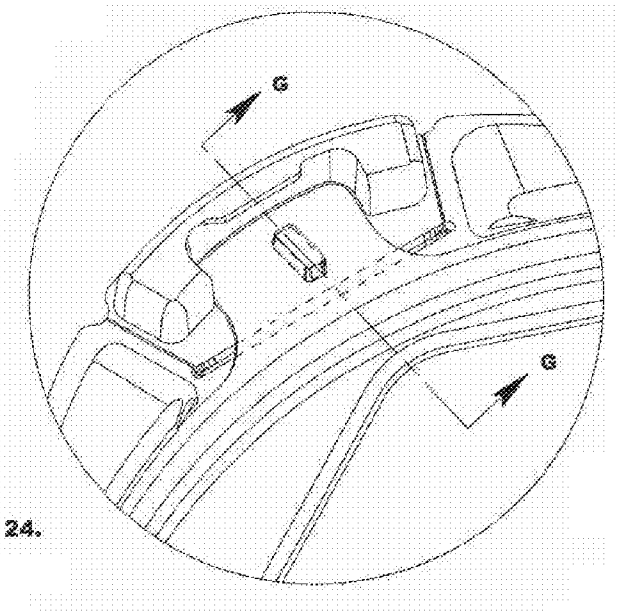
FIG 22.
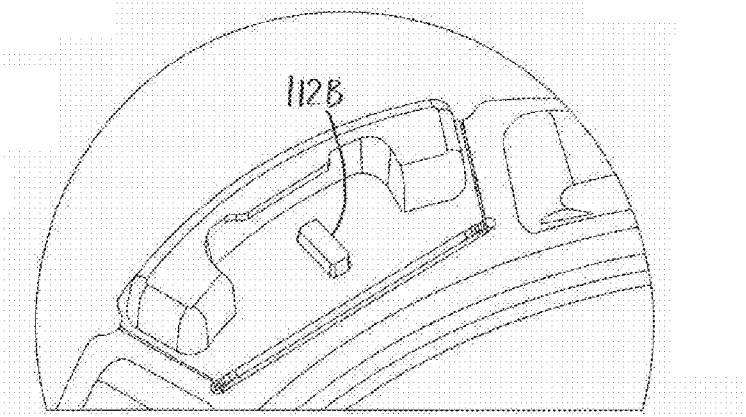
FIG 23.
FIG 24.
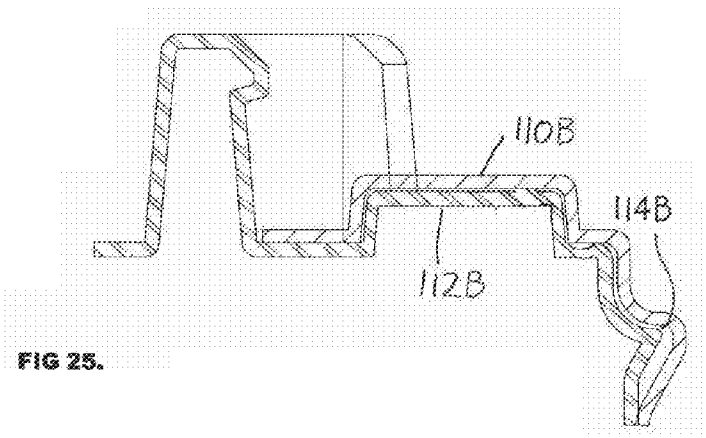
FIG 25.

ENHANCED SECURE CONTAINER

CROSS-REFERENCE

Applicant claims priority from U.S. patent applications Ser. No. 12/075,549 filed Mar. 12, 2008 and Ser. No. 11/879,168 filed Jul. 16, 2007.

BACKGROUND OF THE INVENTION

Food is often placed in a transparent plastic container that includes a base with a large volume cavity that holds the food, and with a lid that closes the cavity. Food is commonly loaded into the cavity by a clerk at a food store, who then closes the container. Customers want assurance that another customer has not secretly opened the container to taste a bit of food (while leaving germs behind) before reclosing it. A container that could be easily closed by a food store clerk and which required a customer who opened the container to tear a part of the container so that part was removed or dangled from the rest of the container, and which left a jagged separation line along a tear line, would be valuable. Since plastic food containers are sold at low costs such as ten cents per container, any such container must be of simple and low cost design.

SUMMARY OF THE INVENTION

In accordance with one embodiment of the invention, a container is provided that includes a base and lid and that is preferably formed of at least one deformed transparent plastic sheet, which makes it evident that the container has been opened after a store clerk loaded it with food and closed it. The base and lid have latched-together portions that cannot be separated until the base and lid are separated at an initial-opening region of the container. The latched-together portions extend around a majority (over 180° about the container axis) of the container, while the initial-opening region extends about a minority (less than 180°) of the container.

At the initial opening region the lid forms a lid lift portion, such as in the form of a radially-outward projecting lid tab, and the base forms a blocker on a tear-away part of the base. The blocker blocks access to the tab (or other lid lift portion). In order to gain access to the lid tab, a person must remove the blocker from a blocking position. Such removal is accomplished by tearing the tear-away part, either partially or completely, from a surrounding portion of the base that surrounds three sides of the tear-away part. The tear-away part is preferably connected to the base surrounding portion by three lines or line areas, with at least one line area requiring tearing and preferably leaving a jagged edge when torn, and with the other line areas requiring tearing or hinging (pivoting). Where one of the line areas is a hinge that cannot be easily torn, opening of the container leaves a dangling tear-away part that is easily noticed. In another container, a lid tab prevents access to a base tab, so a person cannot hold down the base tab until the lid tab is torn.

The blocker that blocks access to the lid tab, can include an upstanding rib that is formed in the base, with the upstanding rib lying higher than the tab. Such upstanding rib has a portion lying very close to the radially outer edge of the lid tab to leave a space of no more than about one millimeter between them. The blocker also has opposite sides that lie close to the opposite sides of the tab. This closeness prevents a person from easily grasping and lifting the lid tab to lift the lid off the base. The initial opening region also can include locators in the form of interfitting parts, one on the base and one on the lid, that fit into one another when the store clerk presses down the lid. The locators can resist initial lift-up of the lid tab and prevent shifting of the tab.

The novel features of the invention are set forth with particularity in the appended claims. The invention will be best understood from the following description when read in conjunction with the accompanying drawings.

DESCRIPTION OF THE DRAWINGS

FIG. 22 is an isometric view similar to that of FIG. 15, but with the tab having a locator that is elongated in the radial direction.

FIG. 23 is an isometric view similar to that of FIG. 16, but with the base having a radially-elongated locator corresponding to the locator of FIG. 22.

FIG. 24 is an isometric view of the initial opening region of a closed container having the radially-elongated locators of FIGS. 22 and 23.

FIG. 25 is a view taken on line G-G of FIG. 24.

FIG. 58 is an upside-down view of the area of FIG. 57.

DESCRIPTION OF THE PREFERRED EMBODIMENTS

Isolated Lid Tab

Figure 1:
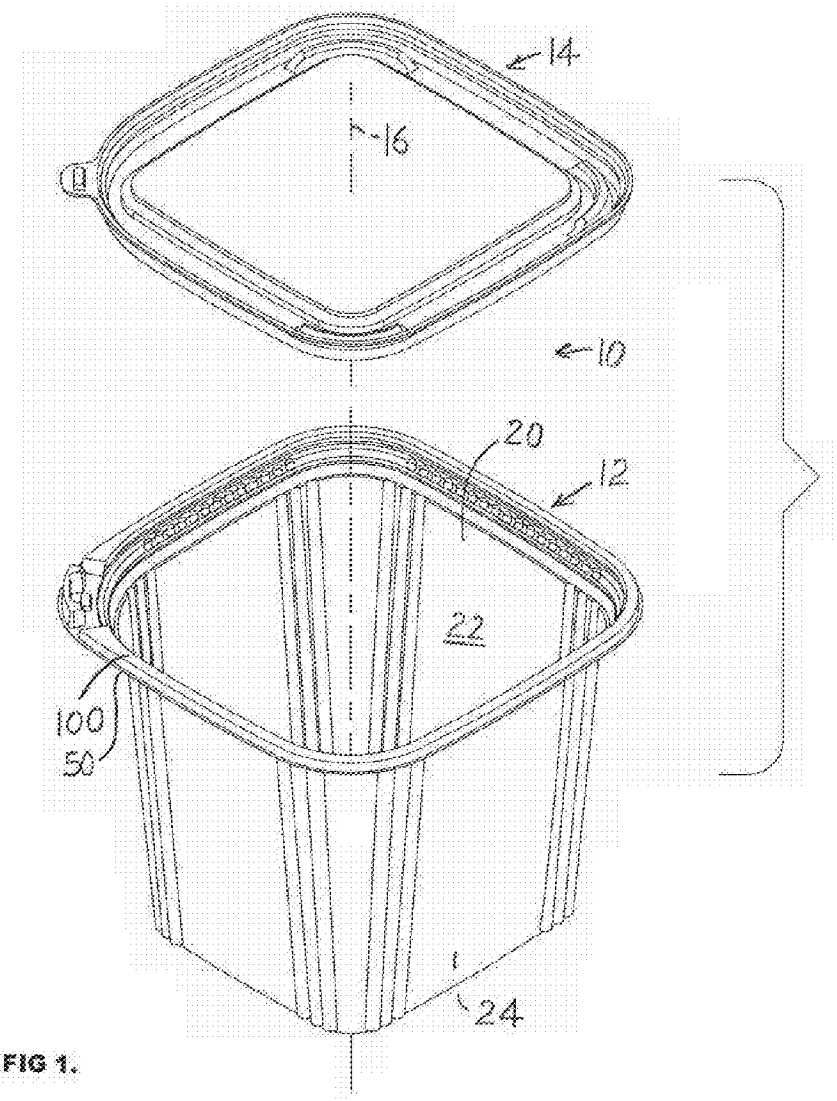
FIG. 1 is an exploded isometric view of a container of the invention, with the lid spaced over the base.
Figure 2:
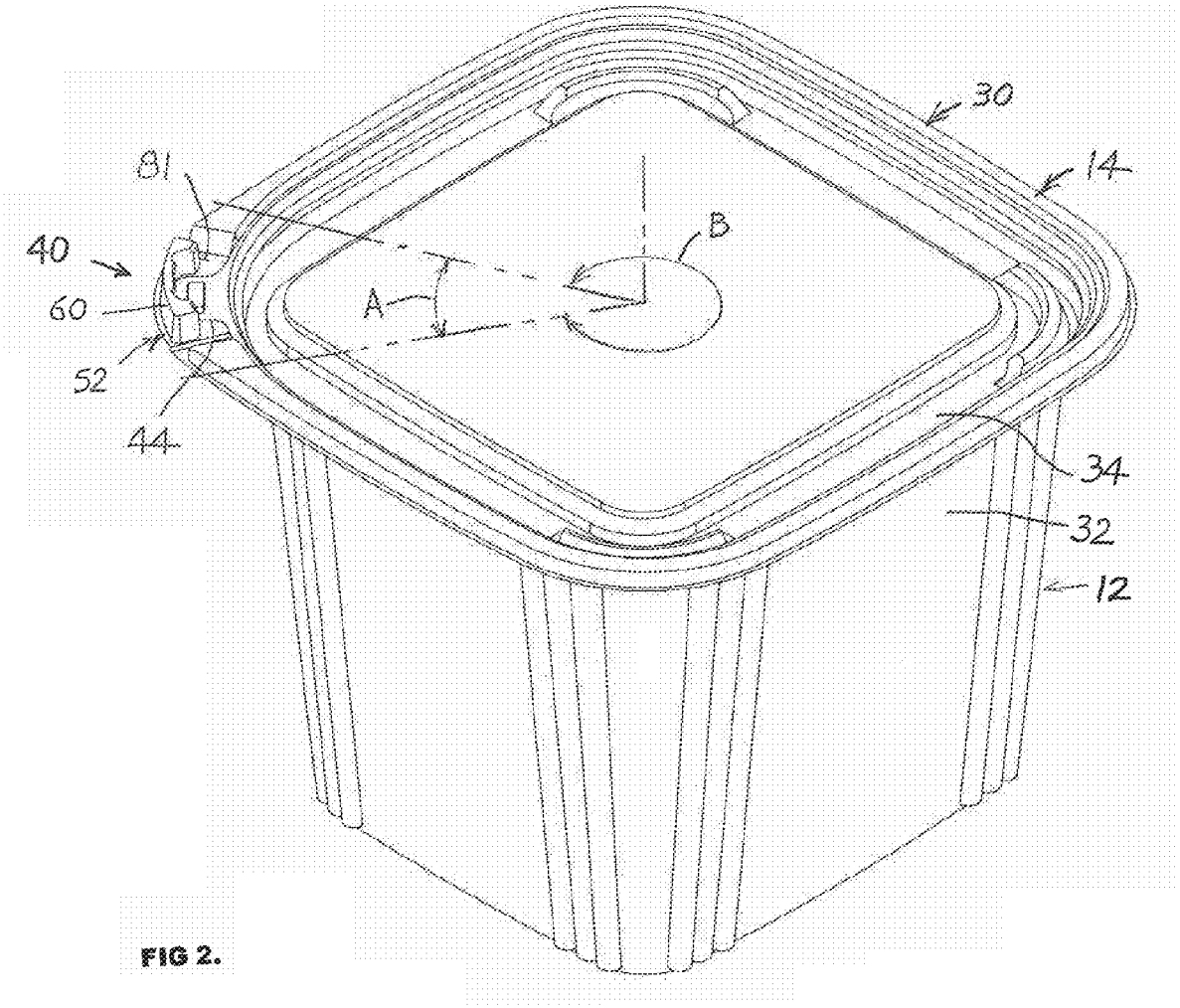
FIG. 2 is an isometric view of the container of FIG. 1 with the lid fully closed on the base.

FIG. 1 shows a container 10 that includes base and lid elements, or a base 12 and lid 14, that are centered on a vertical container axis 16. The container can be formed of one or two plastic sheets, or other material such as fibrous sheets. However, the lid is preferably transparent and therefore formed of clear plastic. Applicant uses the term "plastic" to refer to any sheet material. The terms "radially-inward" and "radially-outward" refer to directions relative to the axis 16. The base has a cavity 20 with primarily vertical side walls 22 and a bottom wall 24. As shown in FIG. 2, the container has a latched-together region 30 where the base and lid have latched-together portions 32, 34, that extend around a majority of the container (i.e. extend by an angle B of more than 180° about the container axis, and usually more than 270°, around axis 16). The latched-together region 30 of the container cannot be opened without great effort after the container has been closed, unless a person first opens the container at an initial opening region 40. The initial opening region 40 extends by an angle A that is less than 180° (and usually less than 90°) around the axis.

Figure 4:
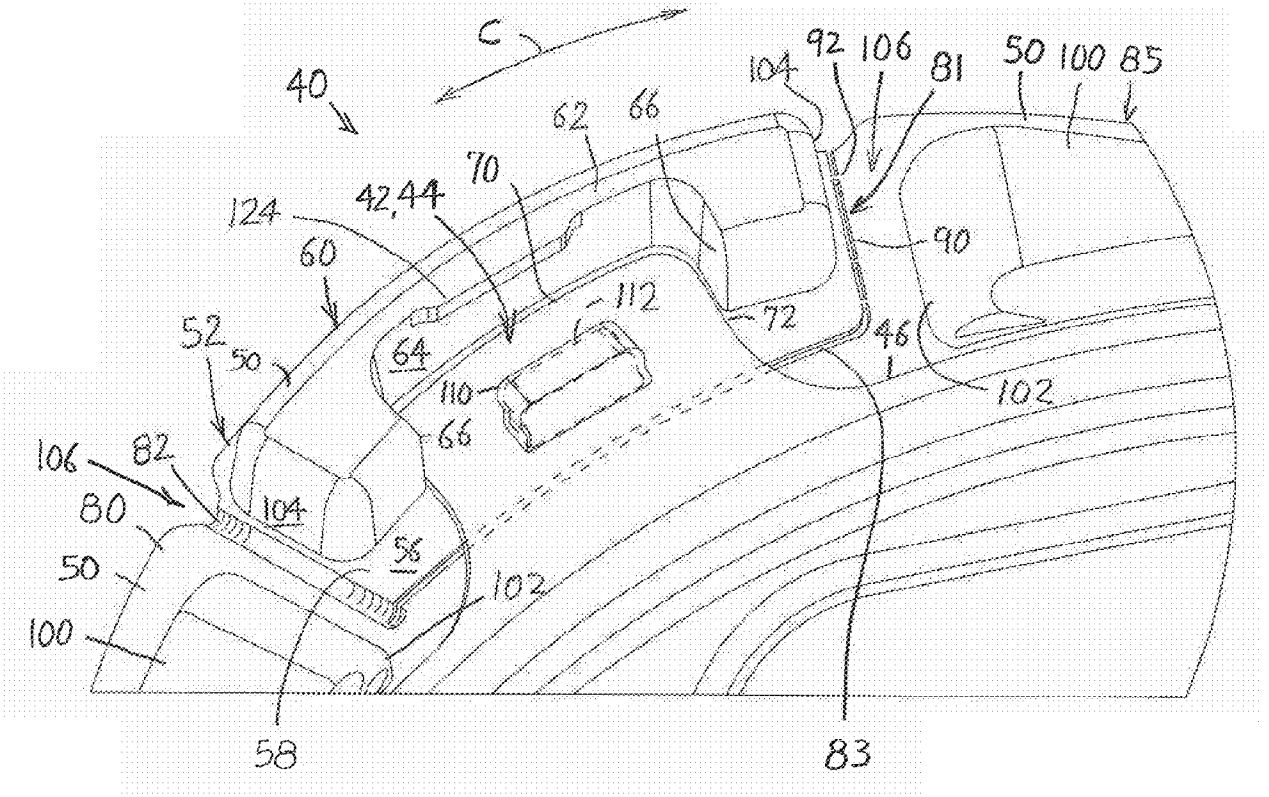
FIG. 4 is a radially-outward looking enlarged view of the initial opening region of the closed container of FIG. 2.

FIG. 4 shows that at the initial opening region 40, the lid has a lid lift portion 42 in the form of a radially-outwardly projecting lid tab 44 that projects radially outward from surrounding portions 46 of the lid. The base has a base rim 50 that forms a tear-away part 52 in the form of a base tab at the initial-opening region 40. The base tab, or tear-away part includes a support wall 56 that is a continuation of the base rim 50 and that has a lid support surface 58 coplanar with the upper surface of the rest of base rim 50. The lid tab 44 lies facewise against or very close to (within a millimeter) the support surface 58. The tear-away part 52 also has a blocker 60 formed by a raised outer blocking rib 62. The blocker 60 extends above the level of the lid tab, and has walls 64, 66 that block access to the radially outer edge 70 and opposite sides 72 of the lid tab. The tab outer edge 70 is narrower (in a circumferential direction C) than the tear-away part 52.

The tear-away part 52 of the base, or base tab, is joined to a surrounding region 80 of the base which includes the base rim 50, by three line areas 81, 82, and 83. The term "line area" refers to an elongated and narrow area. The surrounding region 80 is a portion of a base major part 85 that includes all of the base except for the base tab 52. A first line area 81 extends radially and is a tear line 81 that is weakened so it can be easily torn. Such tearing can be accomplished by applying opposite vertical forces to areas at opposite sides of the tear line, that are less than half (and usually less than one-fourth) the forces that would be required to tear the sheet plastic from an edge where it is not weakened. Such weakening can be accomplished by scoring the plastic sheet along the tear line although this can lead to sharp torn edges. Applicant prefers to weaken the plastic along the tear line by forming perforations 90 along the tear line 81, so the opposite sides of the perforation line are connected by very short connecting parts 92 of the plastic that lie between perforations.

A second line area 82 extends radially and is an elongated area that forms a hinge that allows the tear-away part 52 to pivot about an axis extending along the second line area. Along the length of the hinge 82 the plastic sheet is deflected into a curve and its thickness preferably is reduced. A third line area 83 extends circumferentially (in a direction about the container axis) and is a through cut forming a long gap along which the tear-away part 52 and the base surrounding region 80 are separated.

To open the container, a person first tears along the tear line 81. This allows the tear-away part 52 to pivot down about the hinge 82, and the tear-away part does pivot down under the force of gravity or it is pushed down. With the tear-away part pivoted down, a person can grasp the lid tab 44 between his/her thumb (which lies against the upper surface of the tab) and forefinger (which lies against the previously blocked lower surface of the lid tab). The person then forcefully lifts the lid tab 44 to lift the lid off the base and open the container. Once the initial opening region of the container starts to open, the entire container starts to open.

Figure 5:
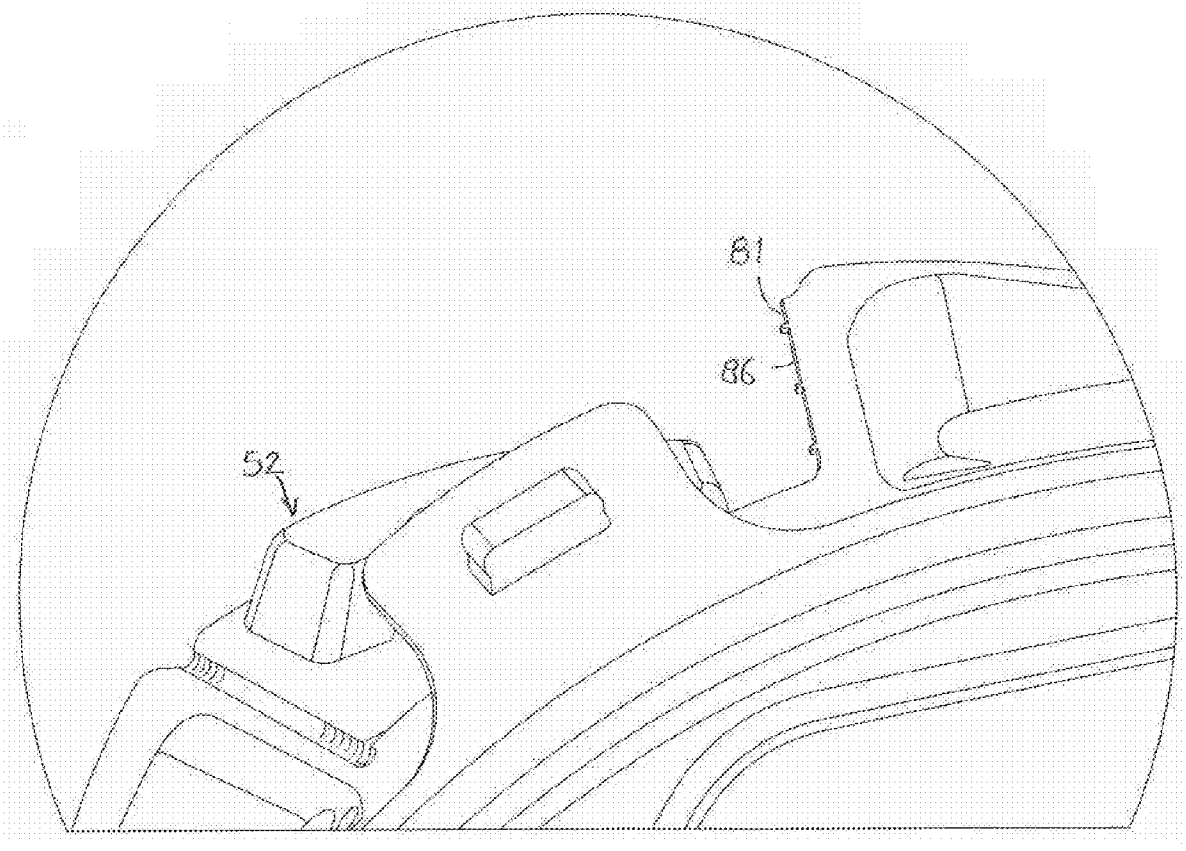
FIG. 5 is an enlarged view of the initial opening region of FIG. 4, after the tear-away part of the base has been torn, unsnapped and moved away from the initial position of FIG. 4, and with the lid tab in the process of being lifted.
Figure 7:
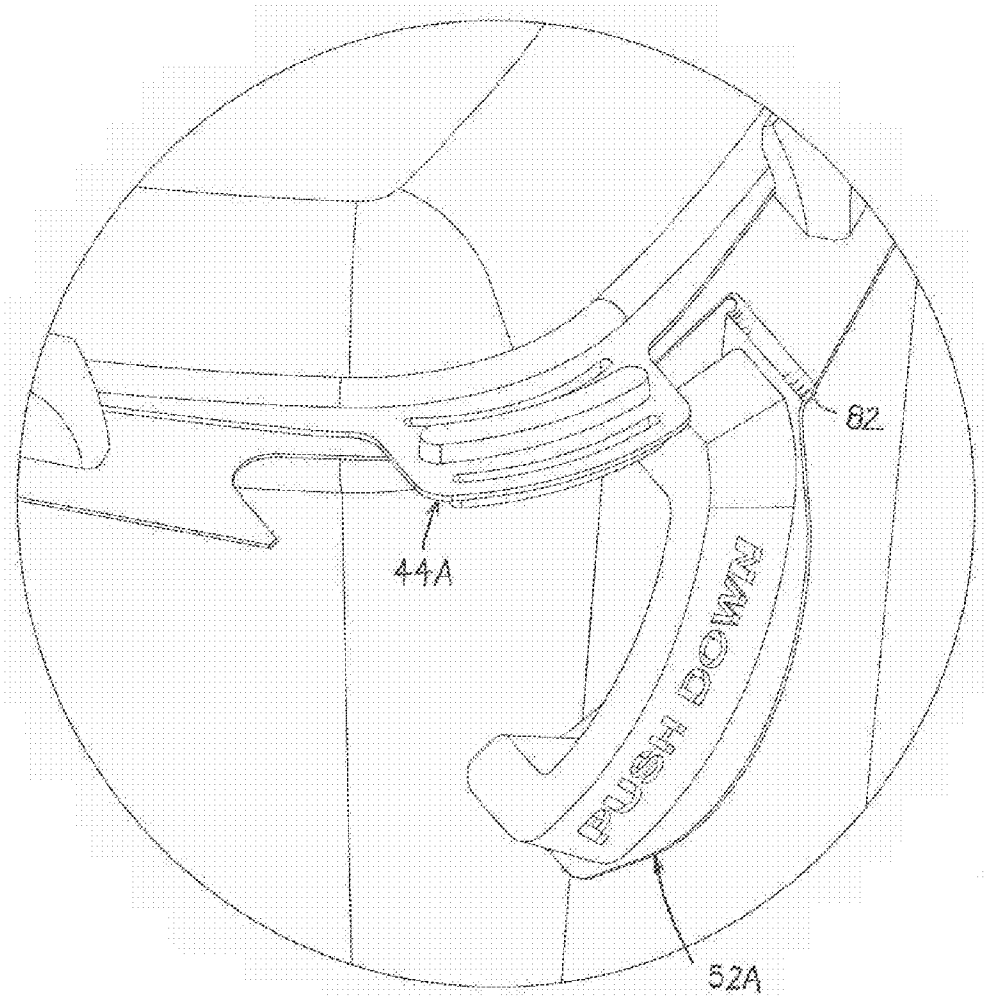
FIG. 7 is an isometric radially-inward looking view similar to that of FIG. 6, which shows the tear-away part of the base after it has been torn free along one line area and with the tear-away part dangling.
Figure 8:
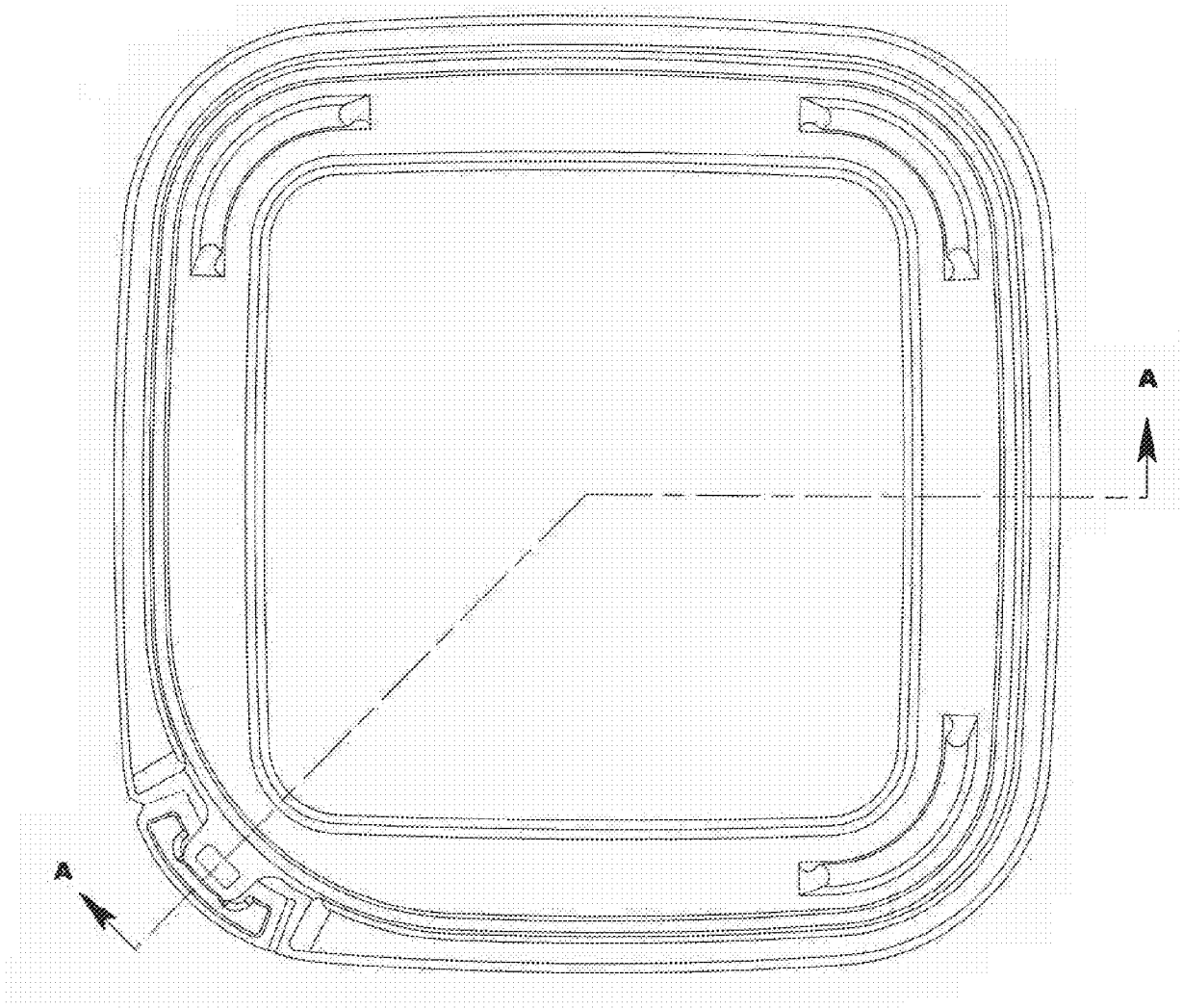
FIG. 8 is a top view of the closed container of FIG. 2.

After the initial opening, the tear-away part 52 will remain dangling from the rest of the base as shown for part 52A in FIG. 7. A customer who sees the tear-away part 52 dangling from the rest of the container at the hinge 82, sees that the container has been opened after it was first closed by the store clerk who loaded food into the container. The fact that it will be apparent when the container has been opened, gives customers confidence that food in the container has not been contaminated by a person who "just wants to taste" the food. This also discourages persons from opening the container before they buy it. FIG. 5 shows that the tear line 81 leaves jagged edges 86 which further indicate a previous opening of the container.

The base has a base main outer rib 100 (FIG. 4) that projects upward above the level of the base rim 50 and that extends all around the container axis except at part of the initial opening region 40. The main outer rib 100 has opposite ends 102 that lie close to circumferentially opposite ends 104 of the blocker 60. Each gap 106 between adjacent ends 102, 104 is preferably less than one centimeter long, and preferably less than seven millimeters long, to prevent a person from inserting a finger though the gap to lift the lid. The lid tab also resists lifting because it lies against the upper surface of the base rim 50.

The lid tab 44 is difficult to pull up before the tear-away part 52 is torn away because the lid tab is closely surrounded by the walls 64, 66 of the blocker 60. In this way, the lid tab is isolated and therefore difficult to grasp to pull up. However, a person still may attempt to secretly lift the lid tab. Applicant further resists unauthorized tab lift by providing interfitting parts, or locators 110, 112 on the lid tab and on the base. The tab locator 110 forms an upward recess, and the base locator 112 forms an upward projection that closely fits into the tab recess (so horizontal movement of one locator relative to the other is less than one millimeter). The tab and base locators 110, 112 preferably snap together, to thereby require additional force to lift the tab off the base.

Figure 12:
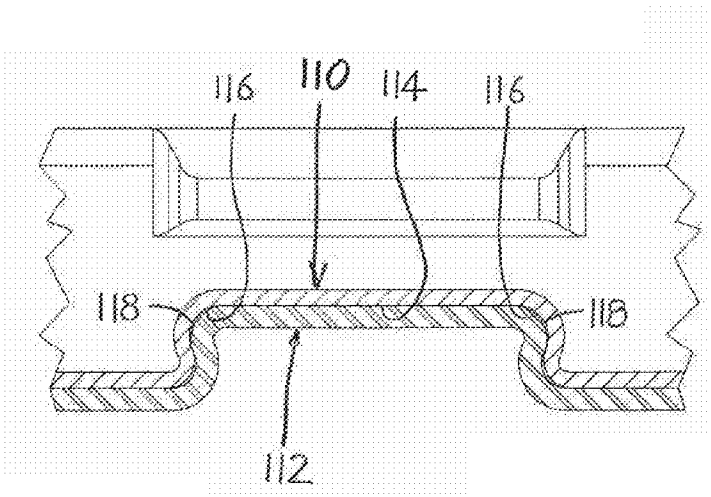
FIG. 12 is a sectional view taken on line D-D of FIG. 11.
Figure 11:
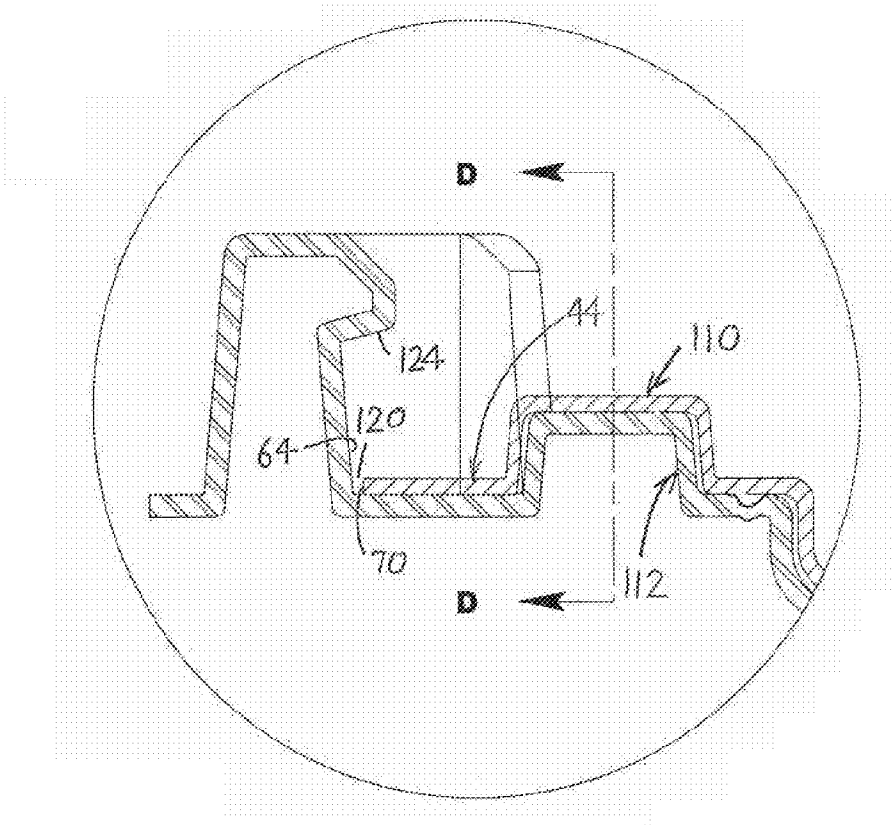
FIG. 11 is a sectional view taken on line B-B of FIG. 9, showing the initial-opening region of the container.
Figure 13:
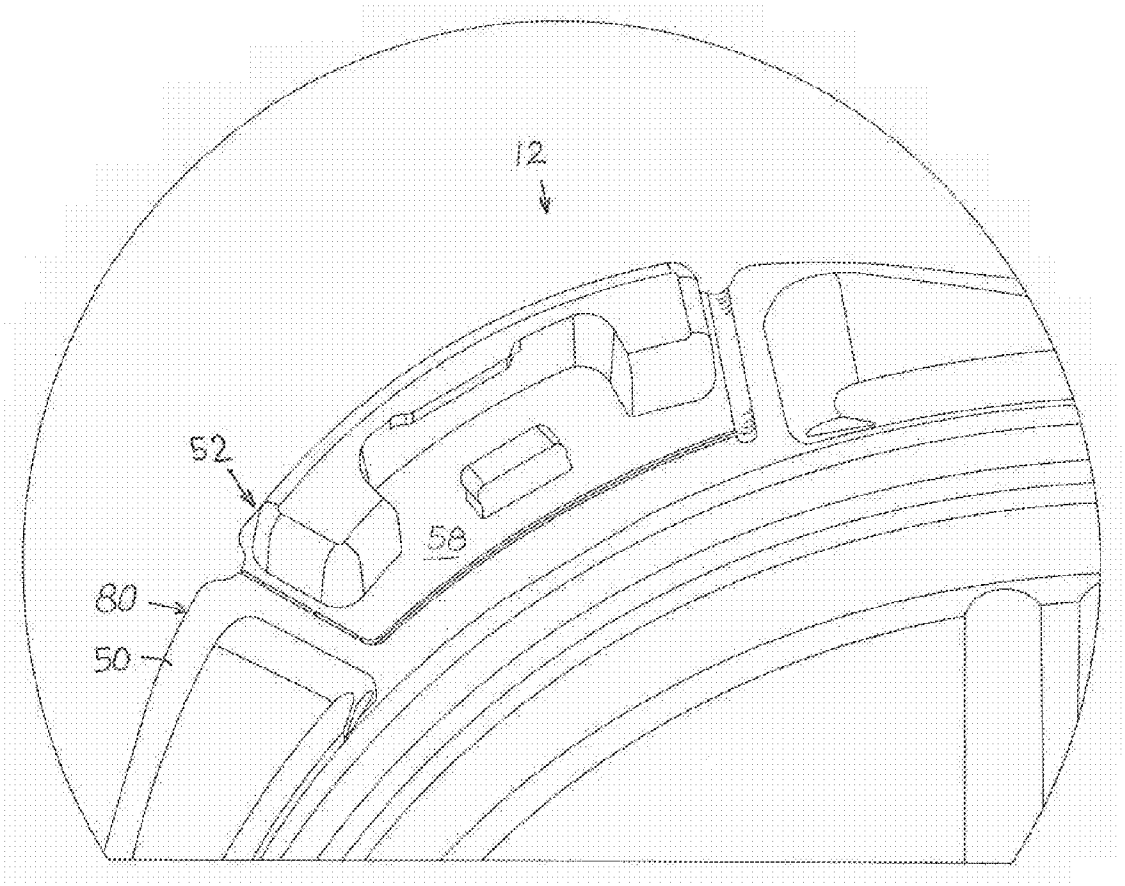
FIG. 13 is a radially-outward looking isometric view of the base portion of the initial-opening region of a variation of the container of FIG. 1, wherein the positions of the tear line and hinge have been switched.

FIGS. 11 and 12 show the tab and base locators 110, 112 interfitting. FIG. 12 shows that the recess 114 of the tab locator has undercuts 116 at its circumferentially opposite ends, and that the base locator has corresponding projections 118 to lie in an interference fit in the recess undercuts of the tab locator. FIG. 11 shows that the locators 110, 112 closely interfit and prevent radial movement of the lid tab 44. This helps assure that the gap 120 between the outer edge 70 of the lid tab 44 and the adjacent wall 64 of the blocker, is small, preferably less than two millimeters and more preferably less than one millimeter. In addition, the radially outer wall 64 of the blocker has an overhang part 124 that overhangs the radially outer edge of the tab to make it more difficult to lift the tab without tearing the tear-away part.

Figures 9, 10:
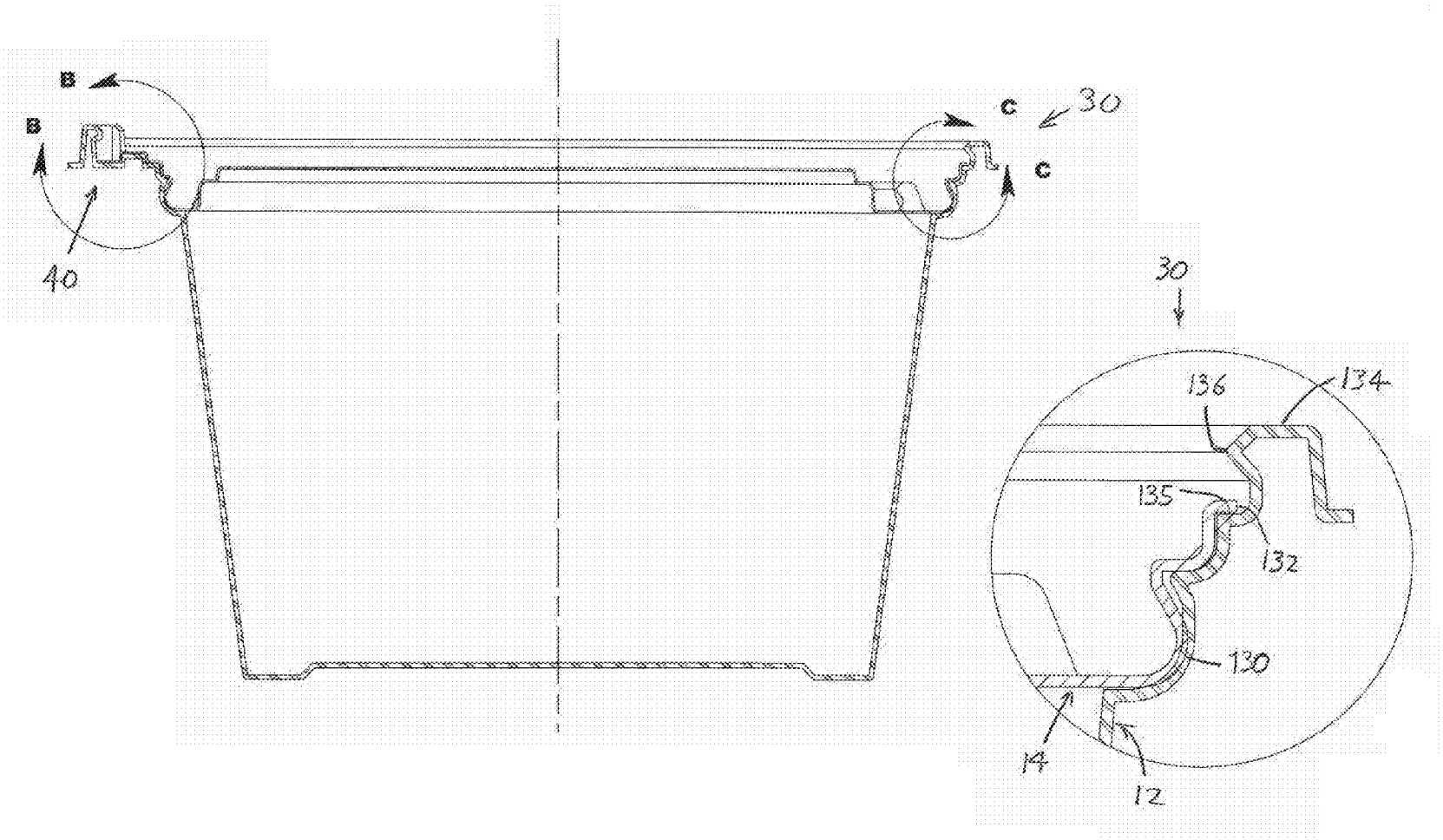
FIG. 9 is a sectional view taken on line A-A of FIG. 8.
FIG. 10 is a sectional view of area C-C of FIG. 9, showing the latched-together portions of the base and lid.

FIG. 9 shows cross-sections of the latched-together region 30 of the container, and the initial opening region 40 of the container. As shown in FIG. 10, along the latched-together region 30 there is an interference fit at 130 between the base 12 and lid 14. The interference fit provides a seal to keep the food fresh, and also resists opening of the container. The lid has a radially outer free edge portion 132 which cannot be grasped because it lies deep (a considerable distance below) and within an outer portion 134 of the base. The free edge portion 132 is pressed down against a base shoulder 135. Even if the lid could be raised slightly, it would abut a radially-inward projection 136 of the base outer portion 134. Only when the initial opening region 40 is opened can the lid be pivoted up and then lifted up.

Figure 3:
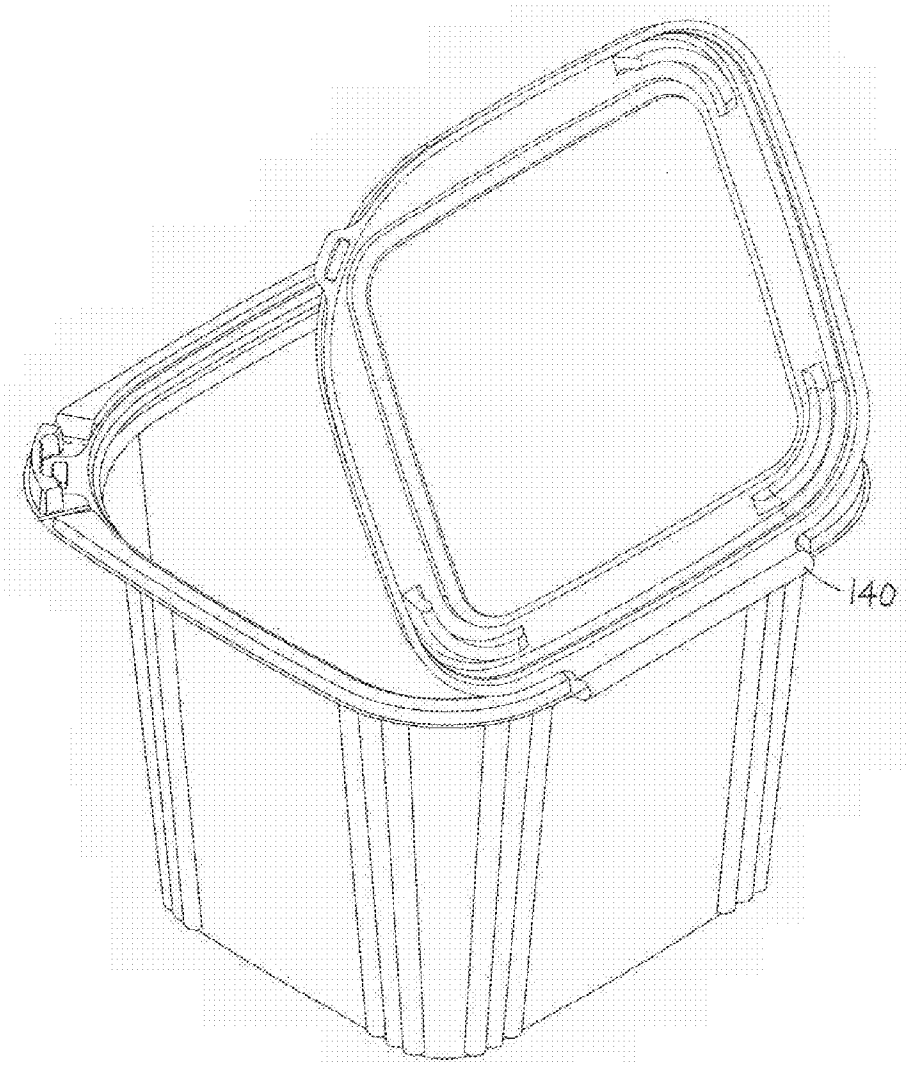
FIG. 3 is an isometric view of a variation of the container of FIG. 2 wherein the base and lid are hingedly connected and are formed of a single sheet of sheet plastic.
Figure 6:
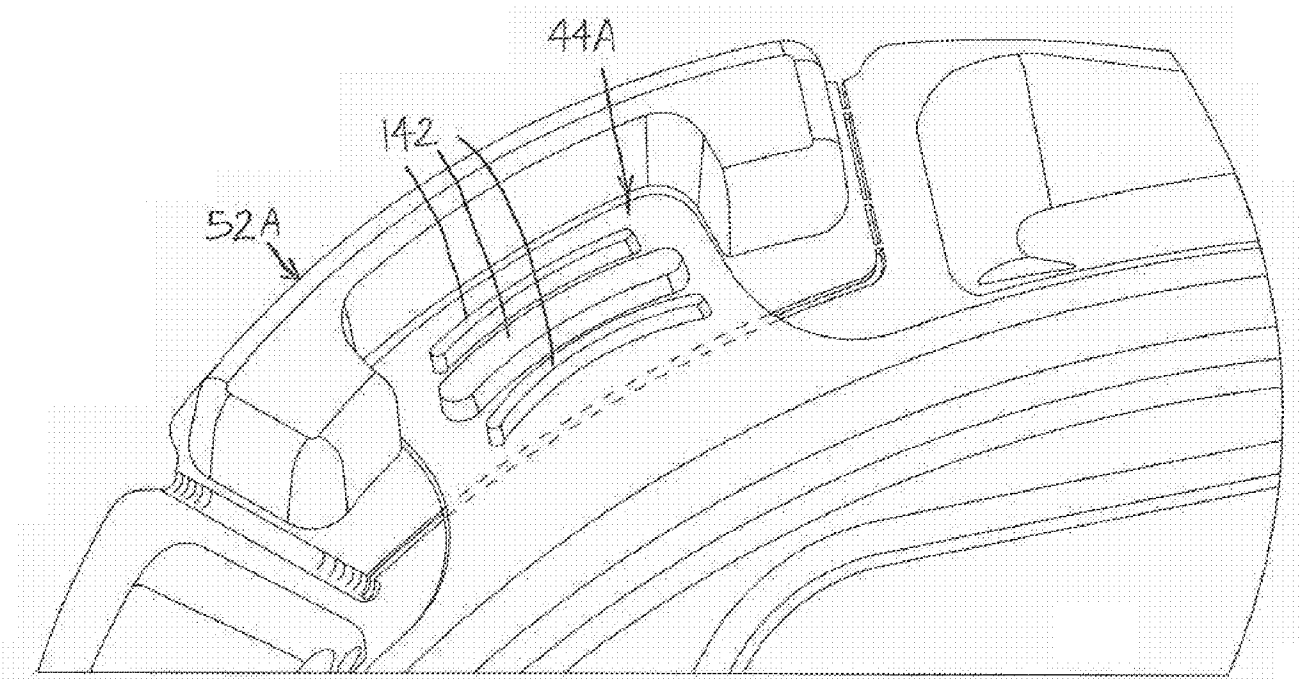
FIG. 6 is an isometric radially-outward looking view similar to that of FIG. 4, showing an enlarged view of the initial opening region, but of a container of a variation of the invention wherein the lid tab has rigidizing flanges.

The other figures show variations of the container of FIGS. 1-2, 4-5, and 8-12. FIG. 3 shows that the base and lid can be formed of a single plastic sheet which forms a hinge 140 between them. The hinge 140 can be used instead of a latched together region. FIG. 6 shows that the lid tab 44A can include corrugations or ribs 142 that provide a "rough" surface that is easier to grasp when lifting the tab. The corrugations also stiffen the tab to resist deflection of either side of the tab. The corrugation shown extend in circumferential directions to enable a person's finger to better resist slipping on the lid tab. FIG. 7 shows a tear-away part 52A after it has been torn along the tear line, so the tab 44A can be grasped.

Figure 14:
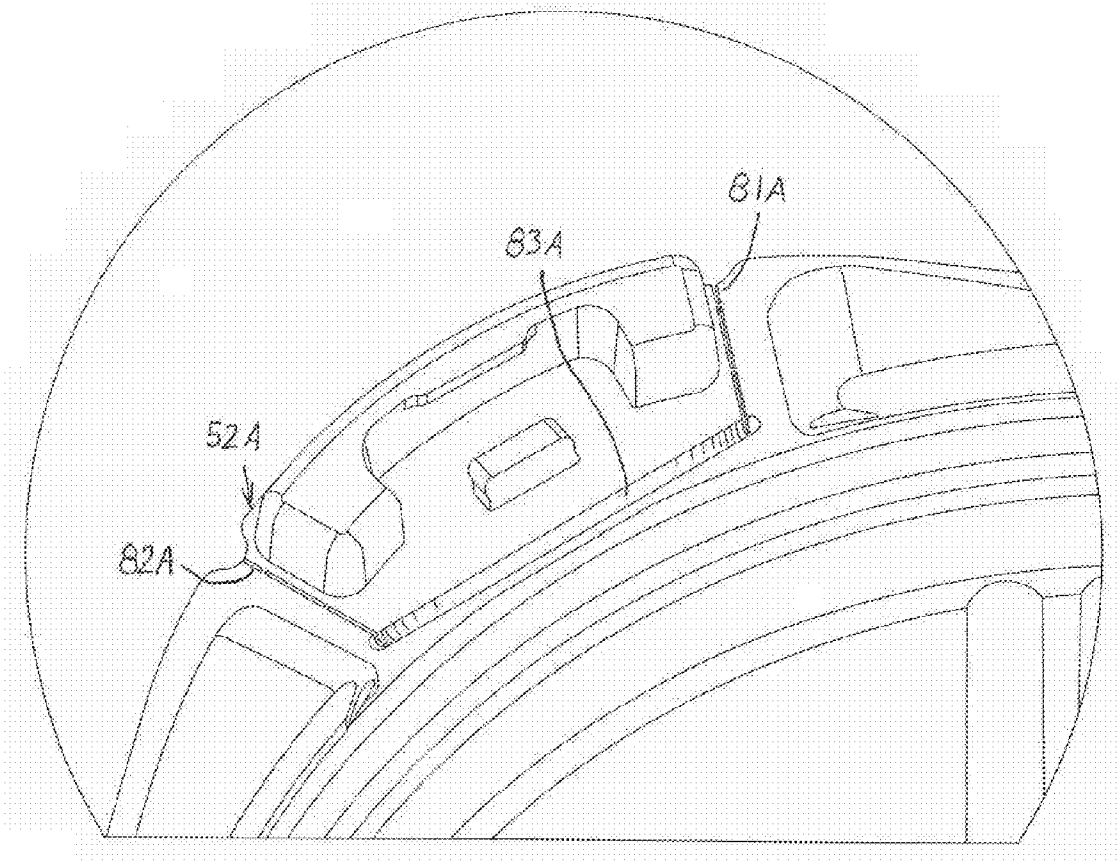
FIG. 14 is a radially-outward looking isometric view of the base portion of the initial-opening region of a container of a variation of that of FIG. 13, wherein two radially-extending line areas are tear lines and a circumferentially-extending line area forms a tear-resistant hinge.
Figure 17:
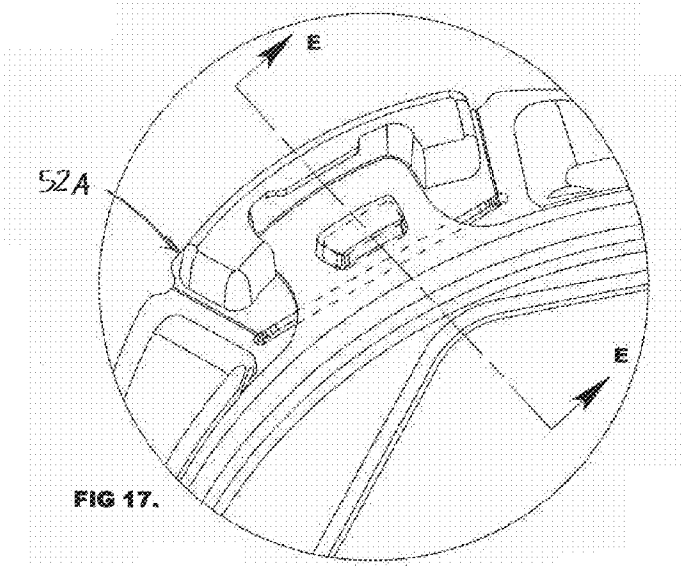
FIG. 17 is a radially-outward looking isometric view showing locators on the lid and base portions of the initial-opening region of FIGS. 15 and 16 interfitting, and with the container fully closed.
Figure 18:
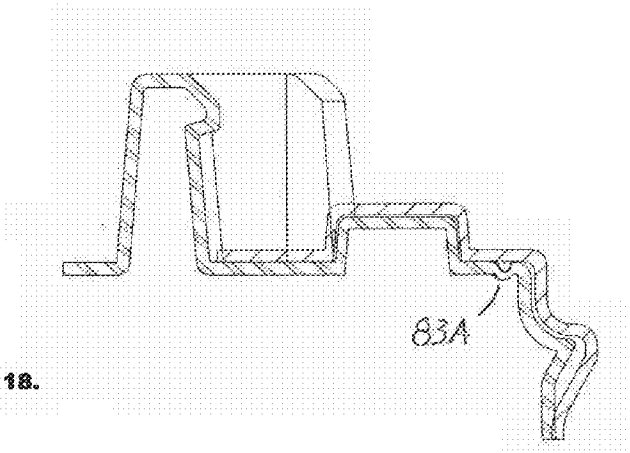
FIG. 18 is a sectional view taken on line E-E of FIG. 17.
Figure 15:
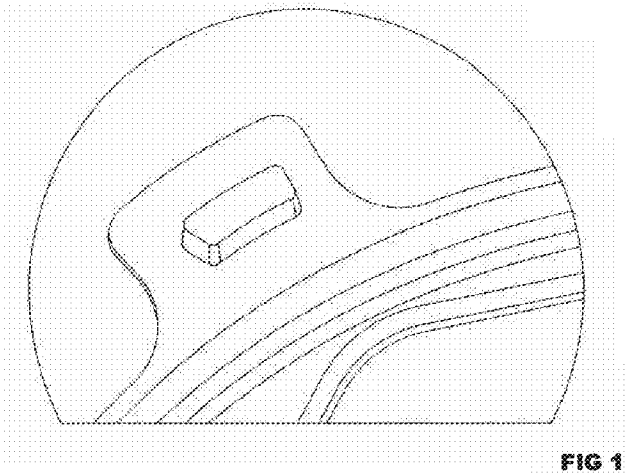
FIG. 15 is a radially-outward looking isometric view of a lid tab, which is the lid portion of the initial opening region of a container where the locator on the lid tab is a variation of that of FIG. 4.
Figure 16:
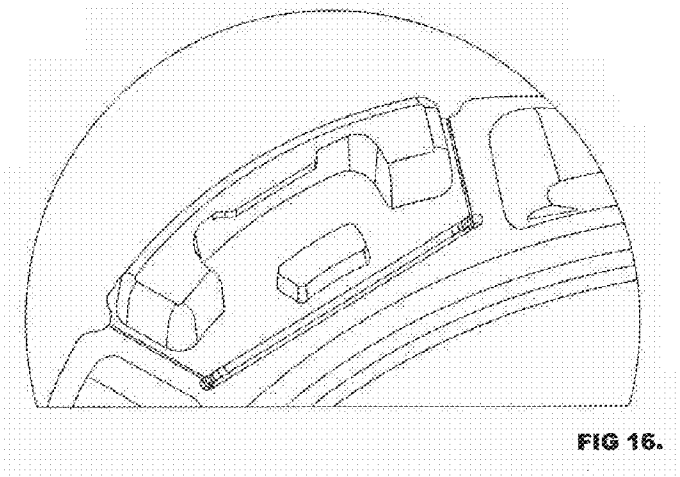
FIG. 16 is a radially-outward looking isometric view of the base portion of an initial-opening region that is designed to receive the lid tab of FIG. 15.
Figure 20:
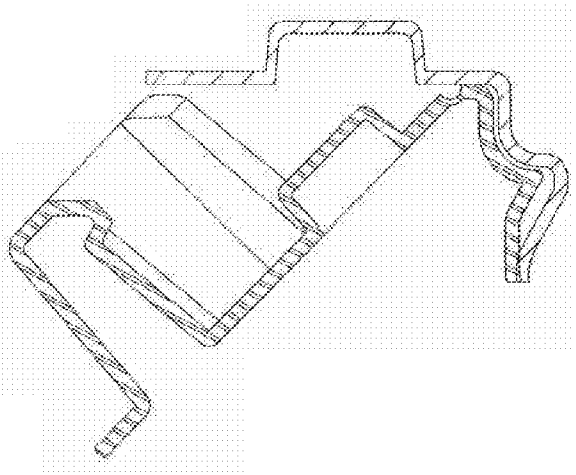
FIG. 20 is a view taken on line F-F of FIG. 19.
Figure 19:
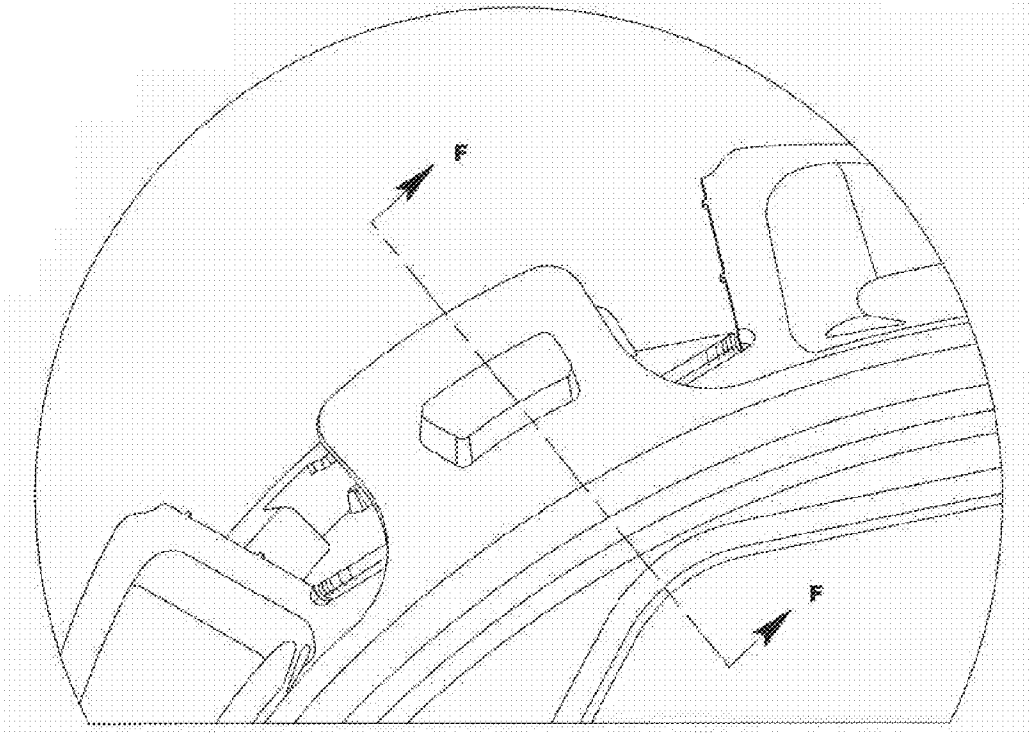
FIG. 19 is a radially-outward isometric view of the container portion of FIG. 17, after the tear-away portion has been torn free along two radial tear lines and the tear-away part has pivoted downward on its hinge.
Figure 21:
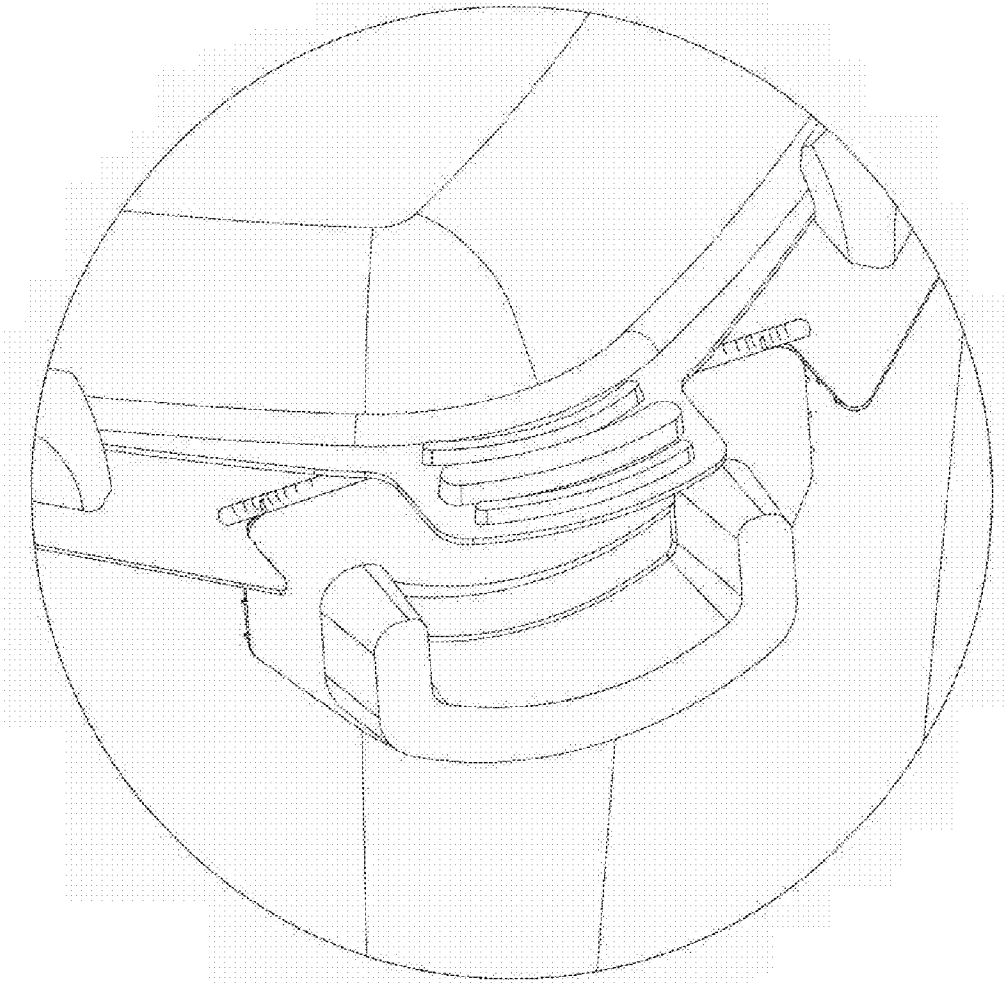
FIG. 21 is a radially-inward isometric view of the container portion of FIG. 19, but with the tab having corrugations.
Figure 28:
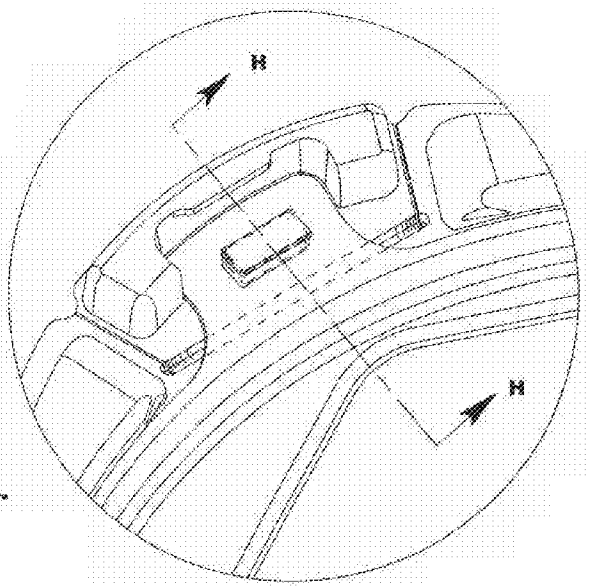
FIG. 28 is a view similar to that of FIG. 17, showing the lid tab and base having interfitting locators.
Figure 29:
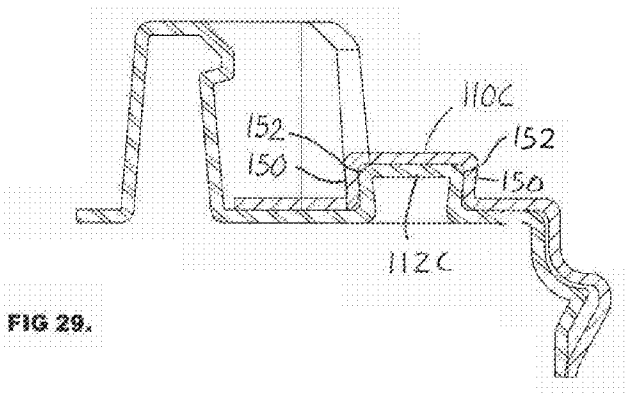
FIG. 29 is a sectional view taken on line H-H of FIG. 28.
Figure 26:
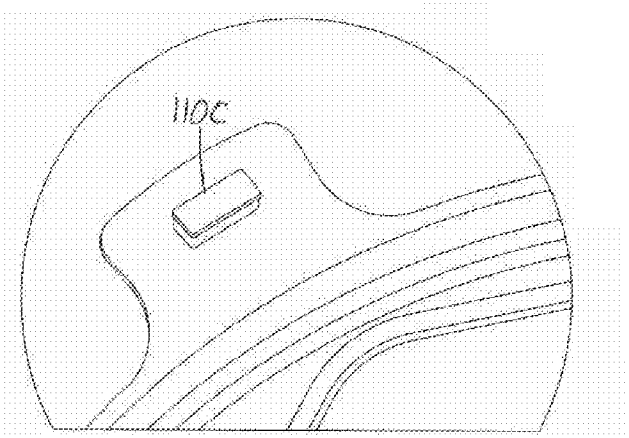
FIG. 26 is a view similar to that of FIG. 15, but with the lid having a locator of a different shape than that of other locators.
Figure 27:
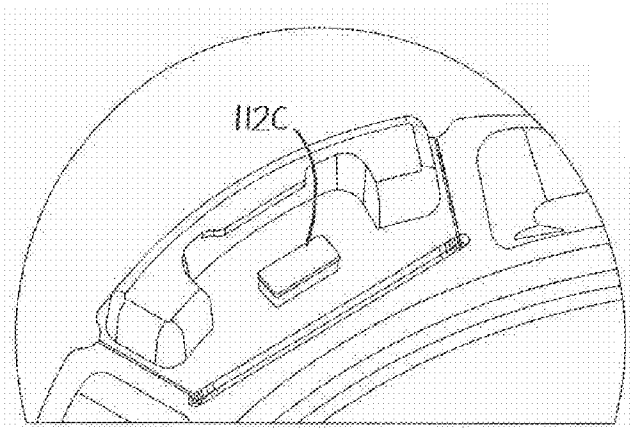
FIG. 27 is a view similar to that of FIG. 16, but with the base having a locator of a different shape that corresponds with the snap locator of FIG. 26.
Figure 32:
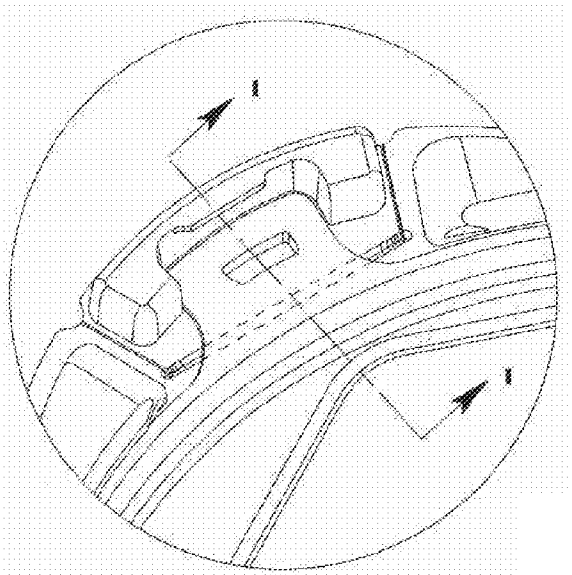
FIG. 32 is an isometric view similar to that of FIG. 17 showing the locators of FIGS. 30 and 31 interfitting.
Figure 33:
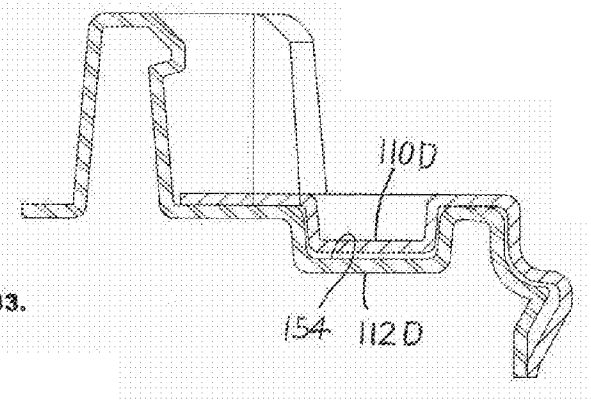
FIG. 33 is a sectional view taken on line I-I of FIG. 32.
Figure 30:
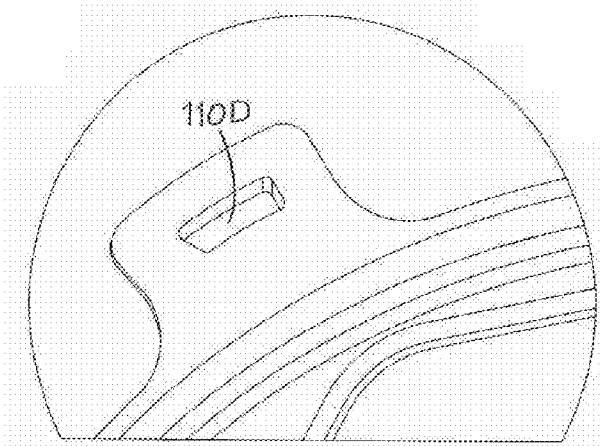
FIG. 30 is an isometric view similar to that of FIG. 15, but with the lid locator formed by a downward depression in the lid tab.
Figure 31:
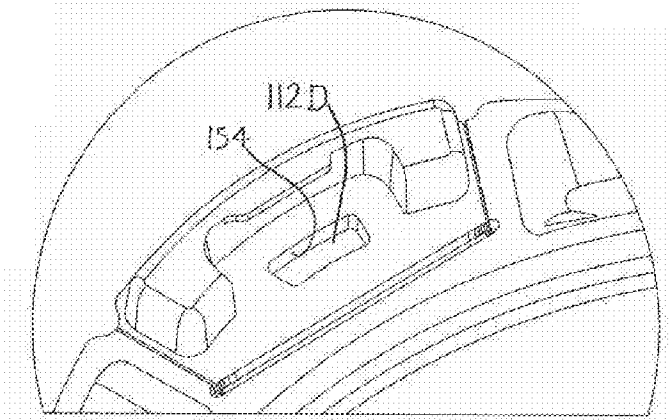
FIG. 31 is an isometric view similar to that of FIG. 16, but with the base locator formed by a downwardly projection in the base tear-away part.
Figure 34:
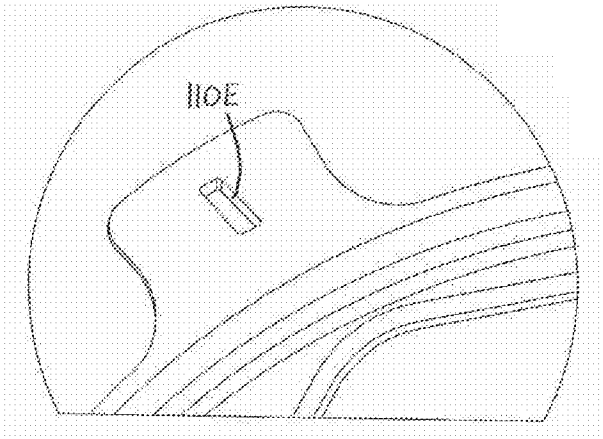
FIG. 34 is an isometric view similar to that of FIG. 30, but with the lid locator elongated in a radial direction.
Figure 35:
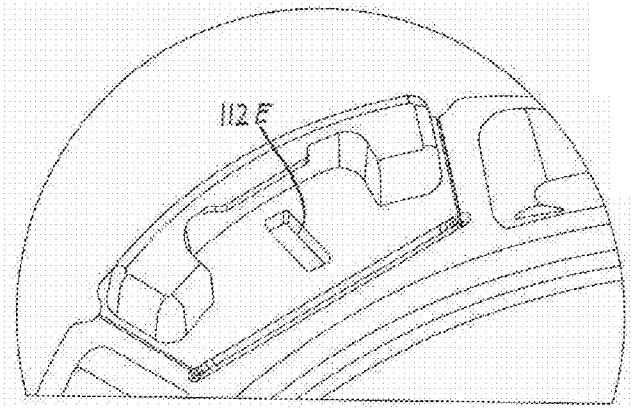
FIGS. 35, 36 and 37 are respectively similar to FIGS. 31, 32 and 34 except that they show radially-elongated locators.
Figure 36:
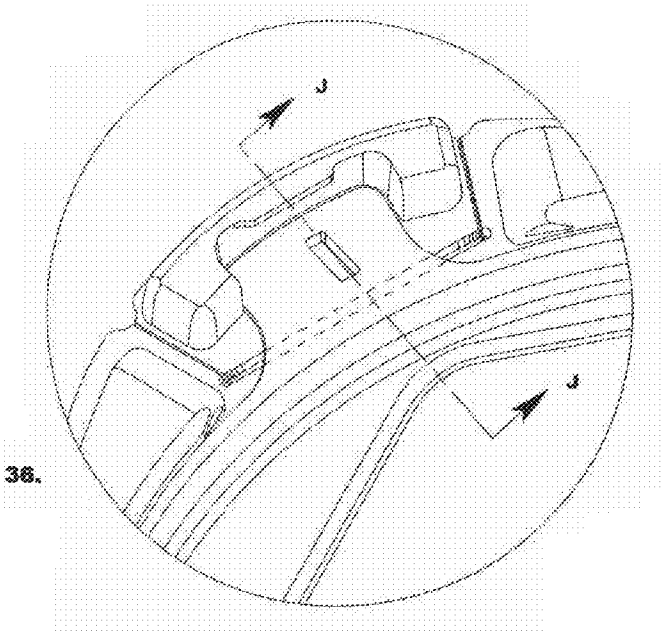
Figure 37:
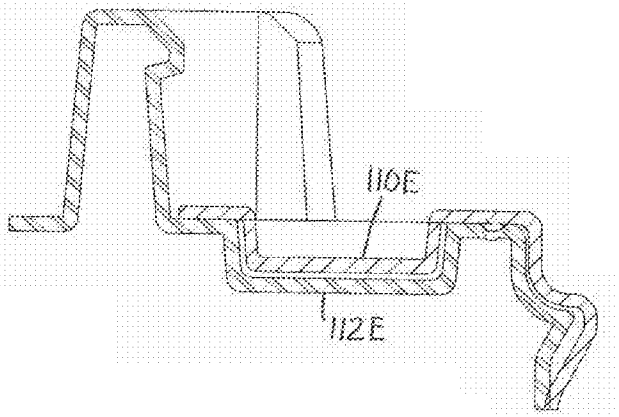
Figure 40:
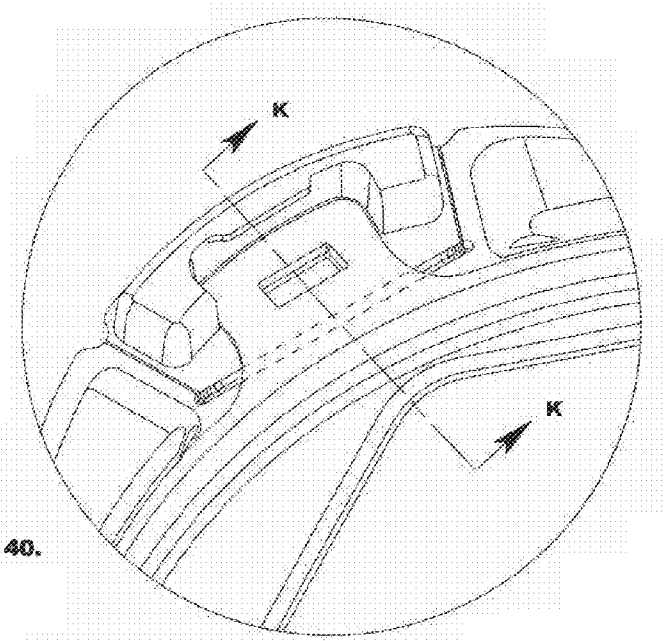
FIGS. 38, 39, 40 and 41 are respectively similar to FIGS. 30, 31, 32, and 33 except that the recesses of the locators are undercut to form snap locks that provide an interference fit.

FIG. 14 shows a container wherein the radially-extending first and second line areas 81A and 82A are both tear lines that are each formed by perforations. The circumferentially-extending third line area 83A forms a hinge. In order to move the tear-away part 52A out of the way so a lid can be lifted, the two tear lines must be torn so the tear-away part can pivot down. FIGS. 15-21 also show the container of FIG. 14.

Figure 41:
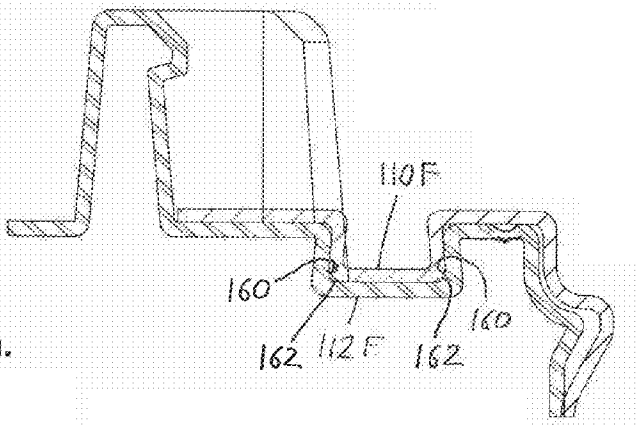
Figure 38:
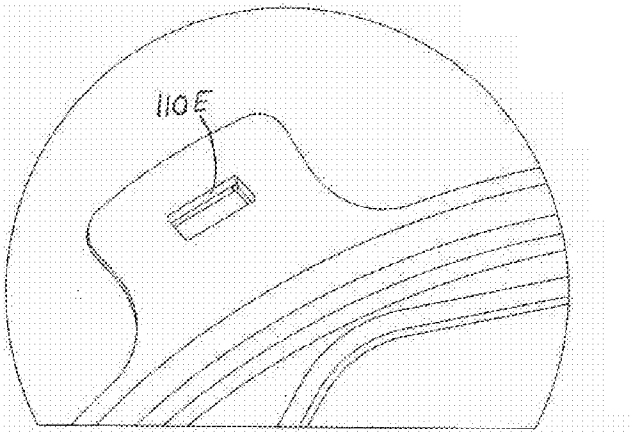
Figure 39:
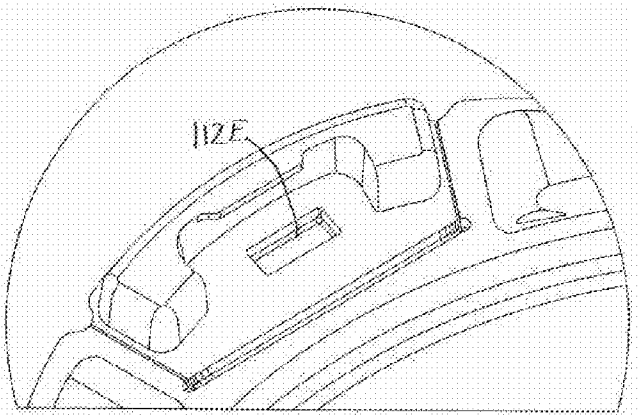

FIGS. 22-25 show a lid tab 44B and show tab and base interfitting part, or locators 110B, 112B that are elongated in a radial direction (rather than a circumferential direction as for the locators of FIGS. 11 and 12). A hinge 114B pivotally connects the lid tab to the rest of the lid. FIGS. 26-29 show a lid tab and base tear-away part with locators 110C, 112C where the tab locator has radially opposite ends 150 that are undercut and receive projecting ends 152 of the base locator. FIGS. 30-33 shows a tab and a base tear-away portion with locators 110D, 112D, where the tab locator 110D forms a downward projection that fits into an upwardly-opening base recess 154 of a base downward projection. FIGS. 34-37 show locators 110E, 112E similar to those of FIGS. 30-33, but with the locators elongated in a radial direction. FIGS. 38-41 show locators 110F, 112F elongated in a circumferential direction. FIG. 41 shows that the base locator 112F forms a recess with radially inner and outer ends 160 that are undercut, and with the tab locators ends 162 fitting into the undercuts to form snap locks.

Figure 42:
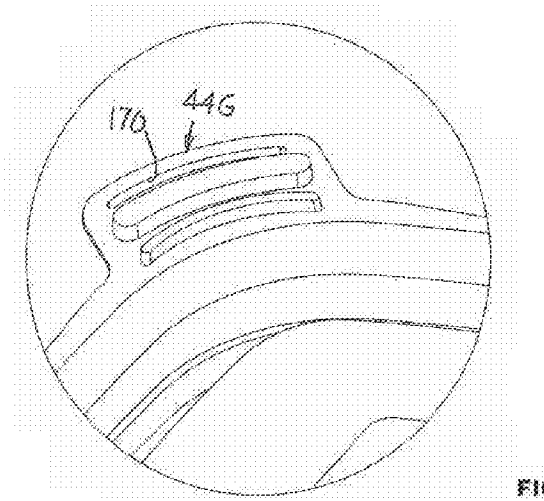
FIG. 42 is an isometric view of a lid tab that has corrugations to enhance gripping and rigidity.
Figure 44:
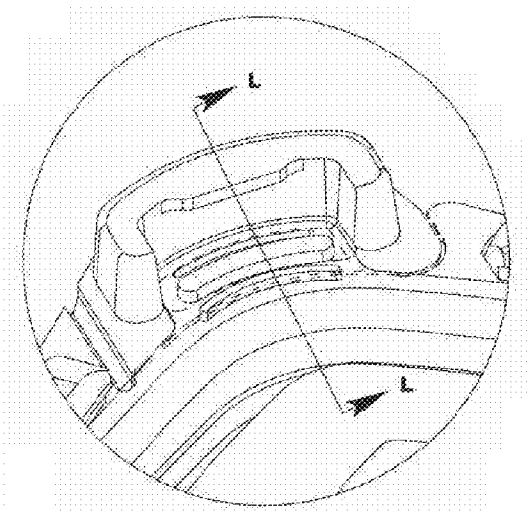
FIG. 44 is an isometric view of the initial opening region of a container, showing the lid tab of FIG. 42 installed on the base portion of FIG. 43.
Figure 43:
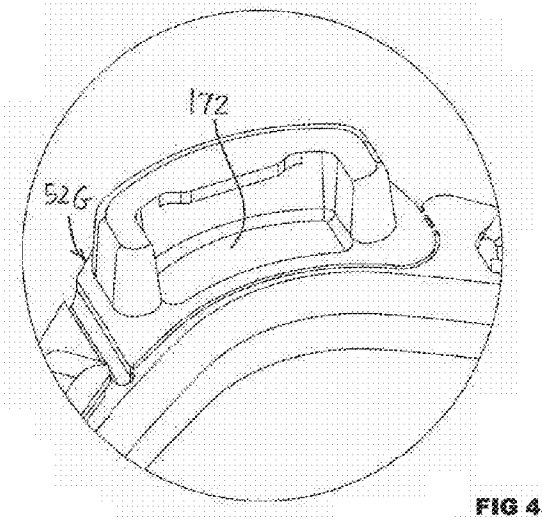
FIG. 43 is an isometric view of the base portion of an initial opening region with a recess that can receive the corrugated lid tab of FIG. 42.
Figure 45:
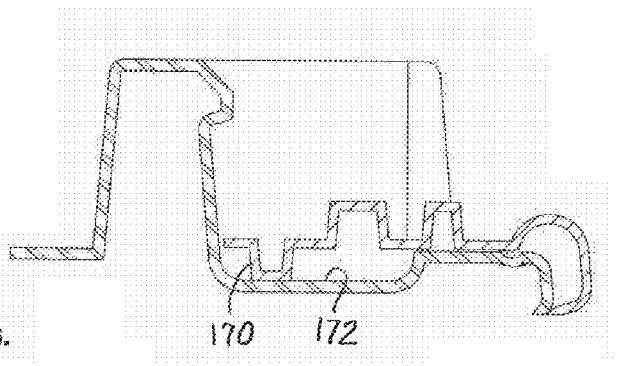
FIG. 45 is a sectional view taken on line L-L of FIG. 44.
Figure 48:
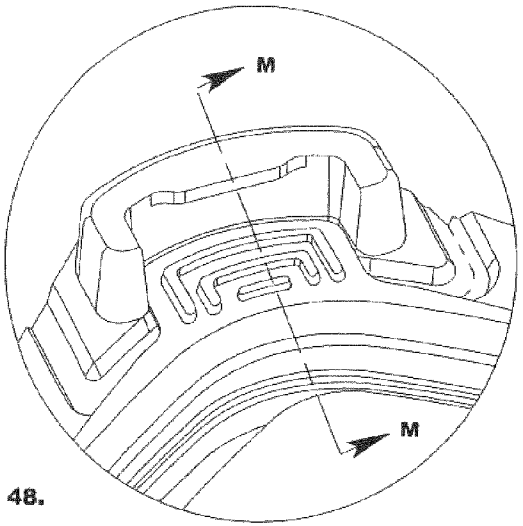
FIG. 48 is an isometric view of only the base portion of FIG. 47.

FIG. 42 shows a corrugated lid tab 44G that is similar to that of FIG. 6, but with one corrugation 170 formed by a downward projection and two other corrugations formed by upward projections. FIGS. 43 and 45 show that the base tear-away part 52G has a recess 172 that receives the corrugation 176 to prevent the lid tab from bending up.

Figure 49:
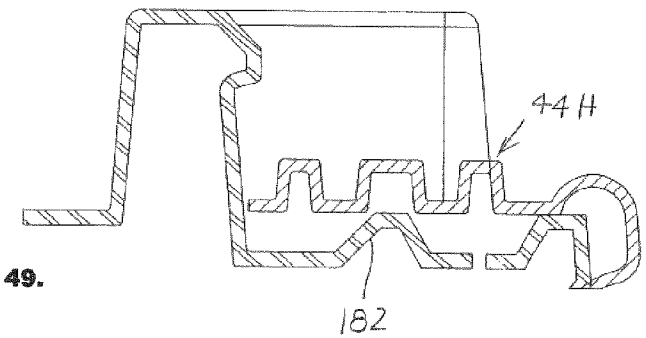
FIG. 49 is a sectional view taken on line M-M of FIG. 48.
Figure 46:
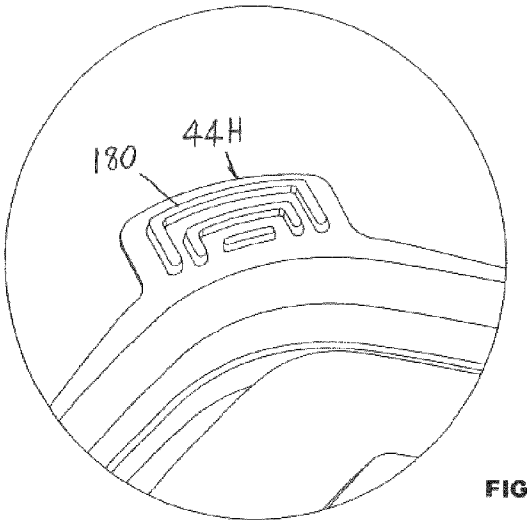
FIG. 46 is an isometric view of a tab with corrugations that extend both radially and circumferentially.
Figure 47:
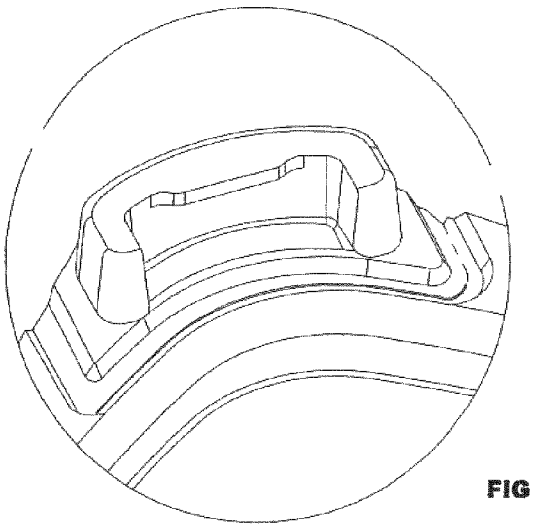
FIG. 47 is an isometric view of the tab of FIG. 46 in a base portion.

FIG. 46 shows a corrugated lid tab 44H wherein at least one of the corrugation 180 extends both circumferentially and radially. FIG. 49 shows that the base has an upward projection 182 that can support the lid tab.

Lid Attachment

Figure 50:
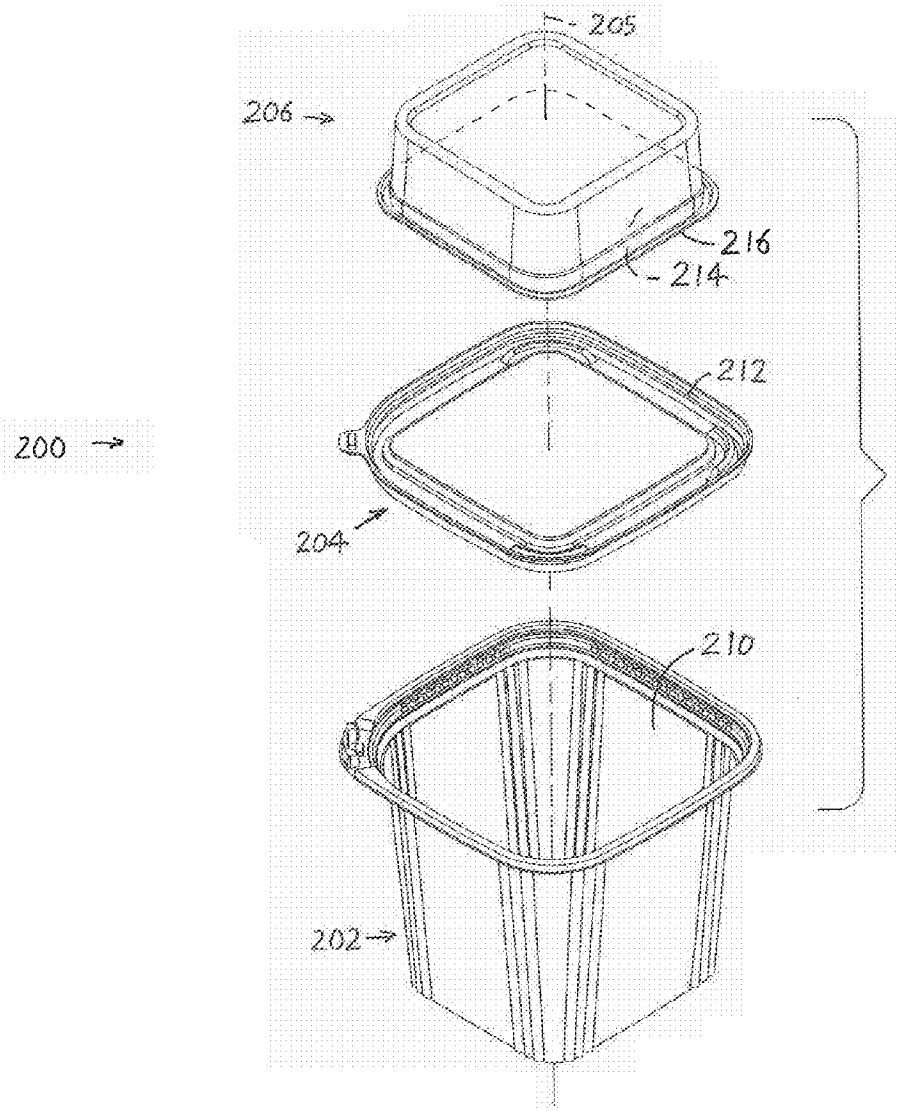
FIG. 50 is an exploded view of a container that includes a lid attachment.
Figure 51:
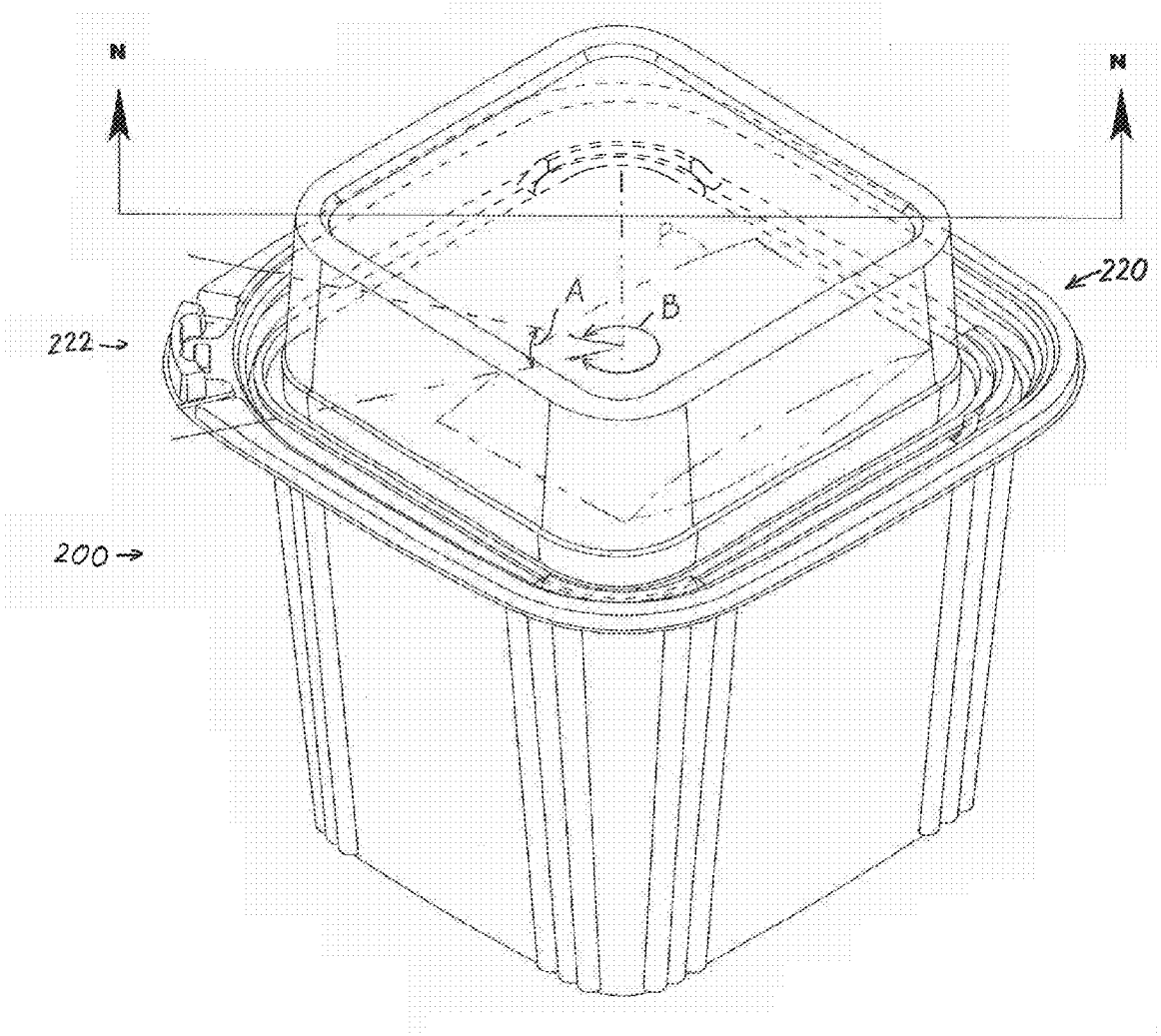
FIG. 51 is an isometric view of the closed container of FIG. 50.
Figure 52:
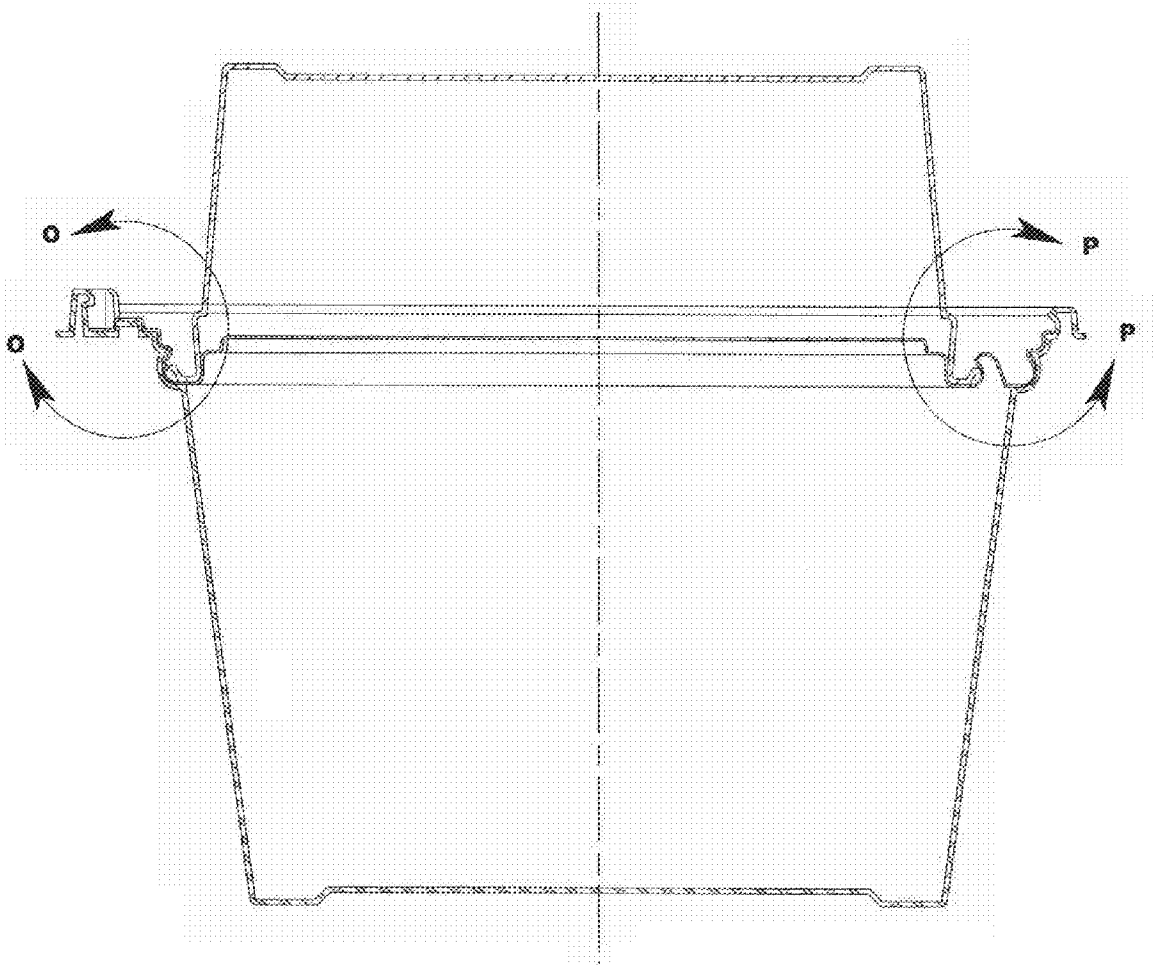
FIG. 52 is a sectional view taken on line N-N of FIG. 51.

FIG. 50 shows a container 200 with a base 202 and lid 204 centered on an axis 205, and with a lid attachment 206 that can be releasably attached to the lid. The lid attachment is useful to hold a food compatible with a food in the base. For example, the lid attachment may hold packets P of different salad dressings while the base cavity 210 holds a salad, or the lid may hold croutons while the base holds a soup. The lid 204 has a groove 212 and the lid attachment is designed to be mounted on the lid, with an attachment cavity, or recess 214 opening downward and with an attachment lower rim 216 latched in the lid groove. As indicated in FIG. 51, the container 200 has an overall construction similar to that of FIG. 2, with a container latched-together portion 220 extending around the container axis by an angle B of more than 180° and with an initial opening portion or region 222 extending less than 180°, such as 30°, around the axis. The lid has a top 226 that is primarily flat.

Figure 54:
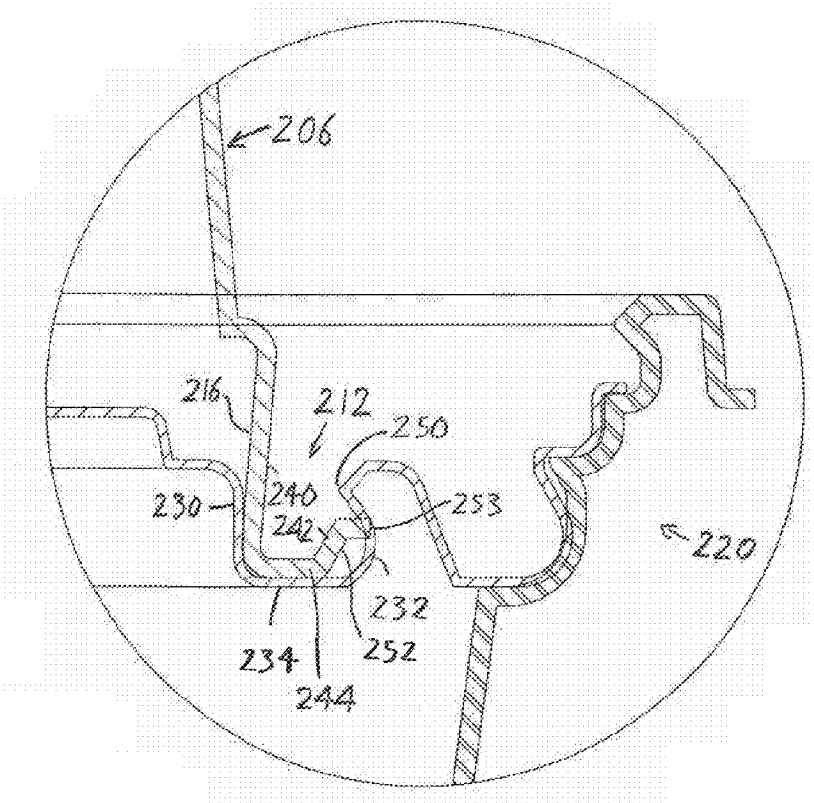
FIGS. 53 and 54 are enlarged views of areas O-O and P-P, respectively of FIG. 52.

FIG. 54 shows how the lid attachment lower rim 216 fits into the lid groove 212 in the latched together region 220. The lid groove has primarily vertically-extending radially inner and outer groove walls 230, 232 connected by a groove bottom wall 234. The lid lower rim 216 is in the form of a hook, with a primarily vertical inner hook wall 240, an outer hook wall 242, and a hook bottom wall 244. The hook-shaped lower rim fits into the lid groove. The outer hook wall 242 forms a latch part 252 that generally extends at an upward and radially outward incline and that has a free end 253. The groove radially outer wall 232 has an inward projection 250 that lies over the latch part 252 of the outer hook wall. The rim, or hook 216 can be pushed down into the groove to mate the lid attachment 206 to the lid. The hook can be removed by forcefully lifting the lid, especially after the opposite side of the lid attachment has been lifted.

Figure 53:
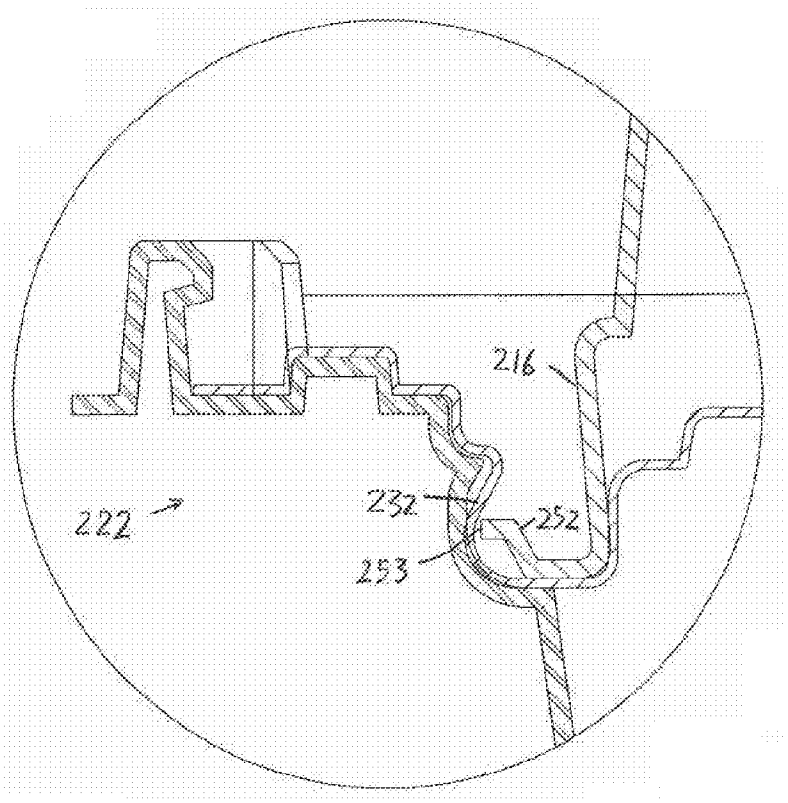

FIG. 53 shows the lid hook 216 in the groove, but at the initial opening region 222. In that region, the latch part 252 is radially slightly shorter so it does not abut the outer groove wall 232. This makes it easier to lift the initial opening region of the lid attachment.

Isolated Base Tab

Figure 55:
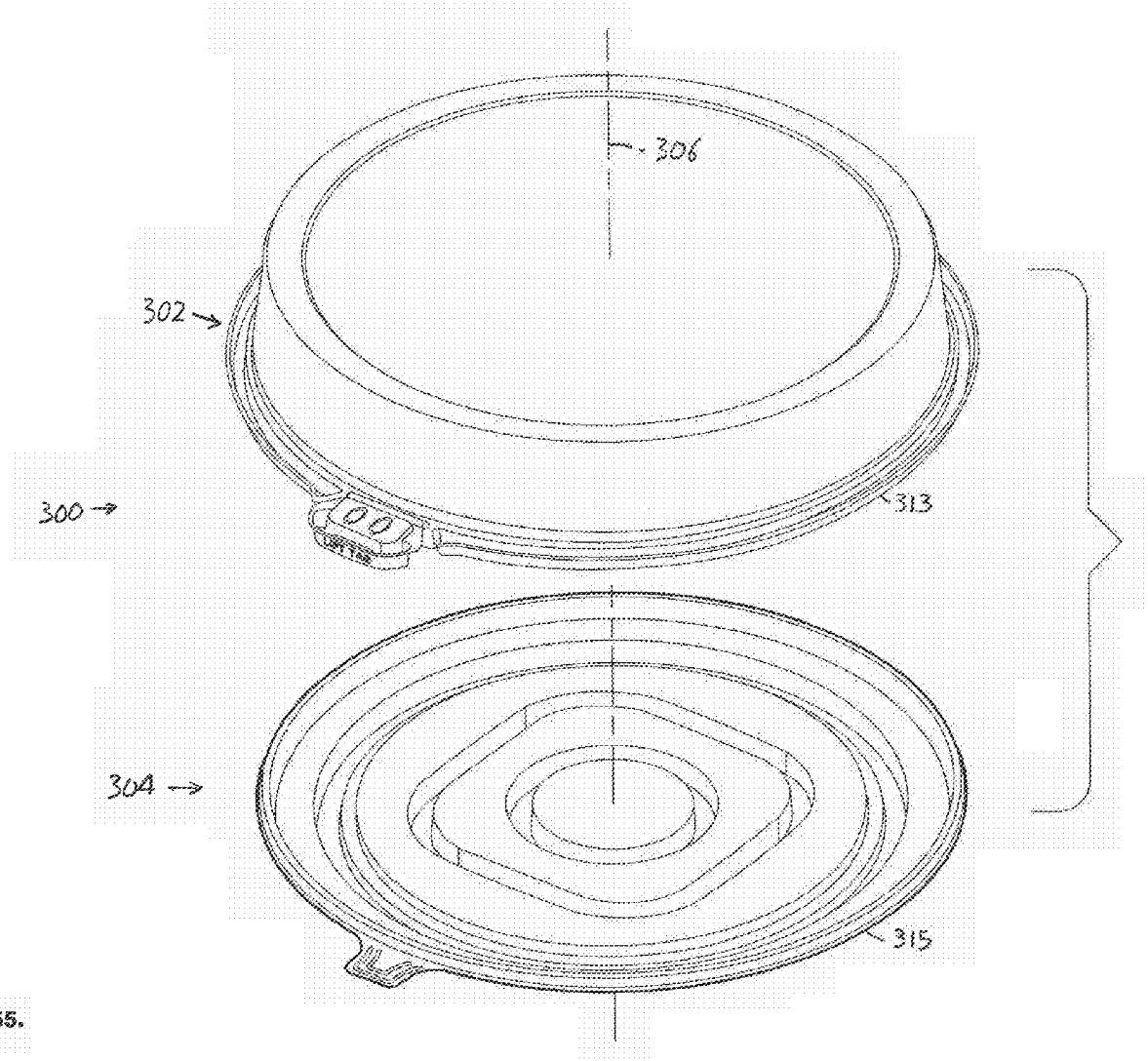
FIG. 55 is an exploded view of a container of another embodiment of the invention.
Figure 56:
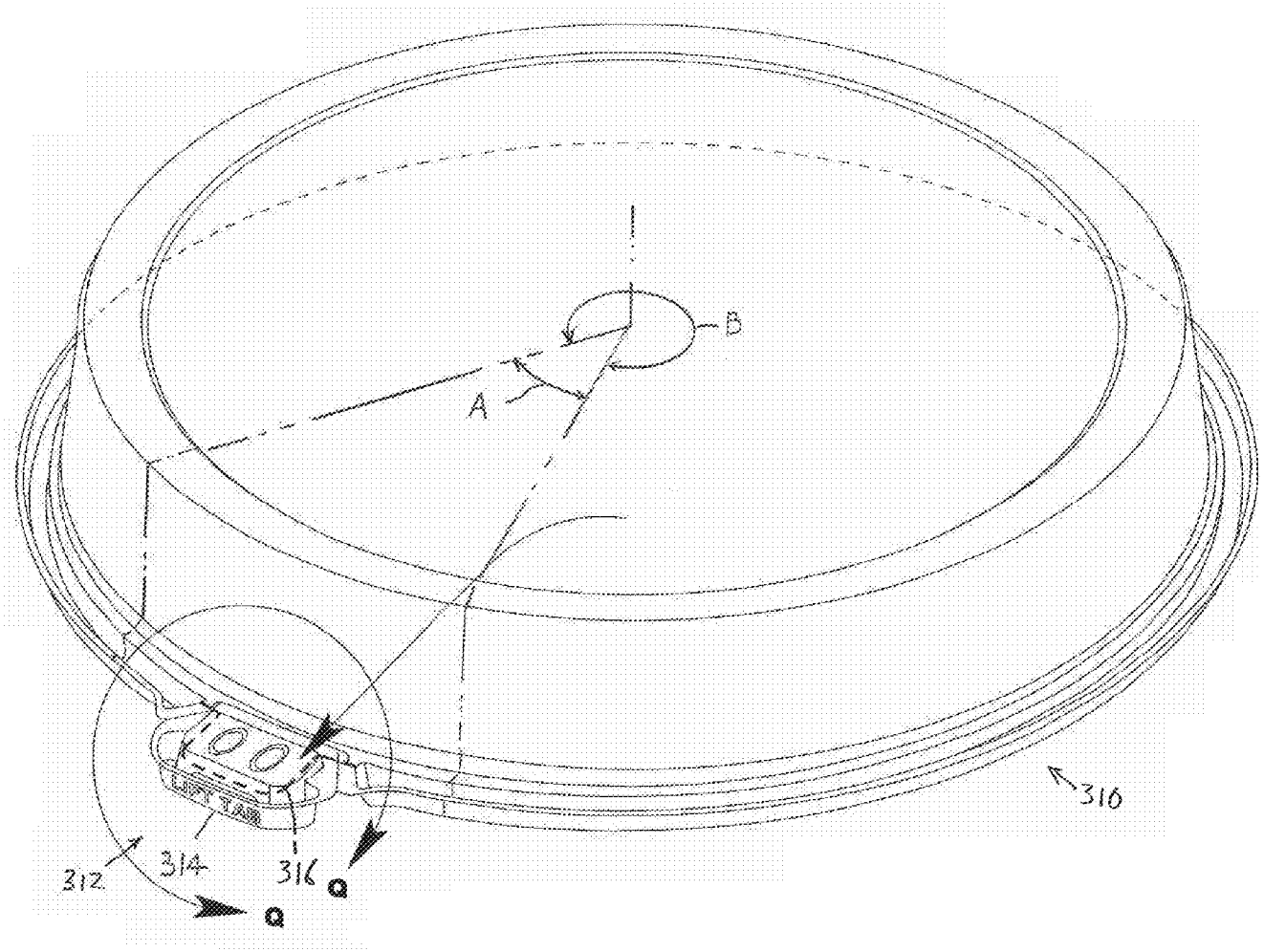
FIG. 56 is an isometric view of the closed container of FIG. 55.

FIG. 55 shows a container 300 that includes a lid 302 and base 304 centered on the container axis 306. FIG. 56 shows that the container has a latched-together portion or region 310 which subtends the angle B about the container axis, and which has a construction similar to that shown in FIG. 10. That is, the latched-together region 310 greatly resists opening until an initial opening portion or region 312 that subtends angle A, has been opened. The initial opening region 312 has a lid tear-away region in the form of a lid tab 314, and has a hidden base tab 316. Around the latched-together region 310 the lid outer edge (313) lies over the outer edge (315) of the base so the base cannot be held down. It is only necessary that the base edge not project more than a half centimeter radially beyond the lid edge although applicant completely covers the base edge.

Figure 57:
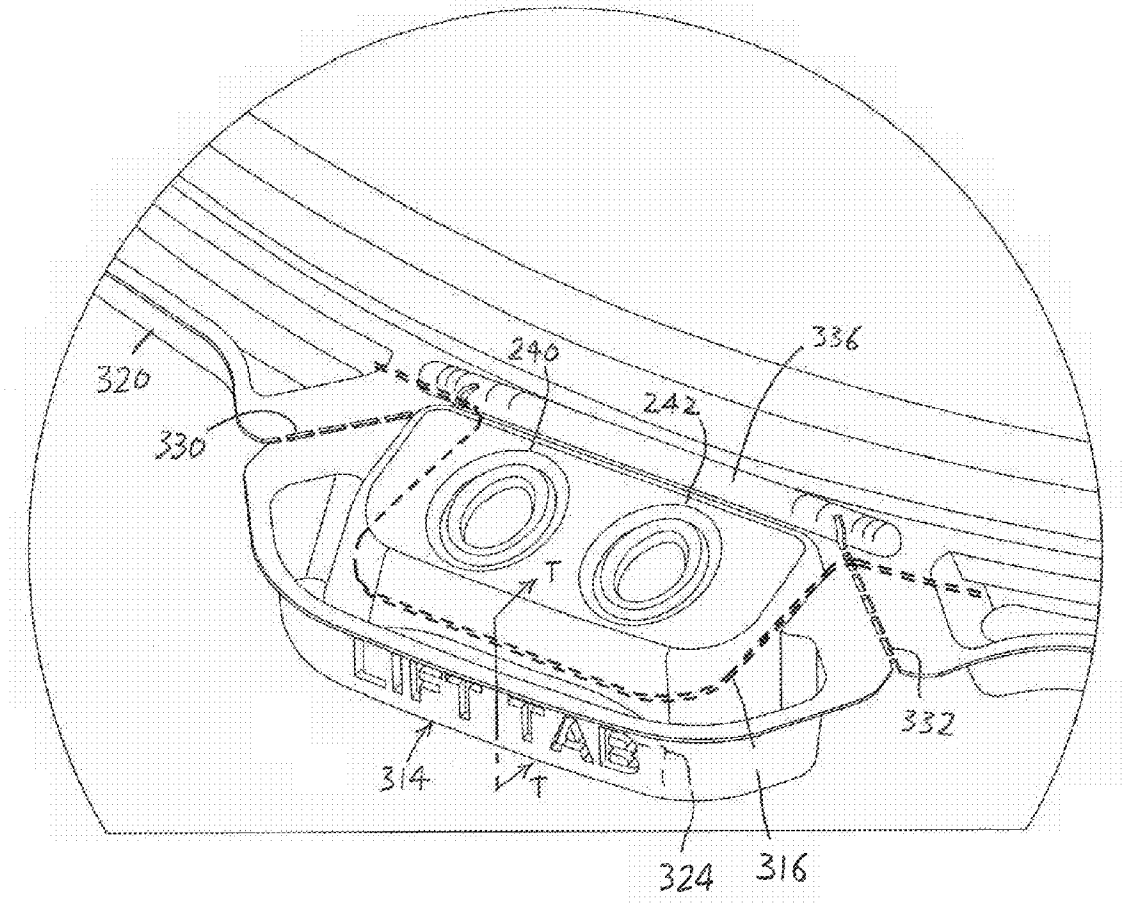
FIG. 57 is an enlarged view of area Q-Q of FIG. 56.

In order to open the initial opening region, a person must grasp the hidden base tab 316 to hold down the base, while lifting the lid by grasping and lifting the lid tab 314. However, as shown in FIG. 57, the base tab 316 is hidden, or isolated, to prevent a person from grasping it to hold down the base, until part of the lid tab 314 is torn free of a surrounding portion or region 320 of the lid. The surrounding region 320 lies beyond line areas 330, 332 and radially inward of line area 336. FIG. 58 is an upside-down view showing the bottom of the initial opening region 310, showing that the lid tab has a recess 322 in its underside and the base tab 316 lies in the recess. Also, the lid tab has an underhang 324 (that would be called an overhang if it was as the top) that tends to trap the base tab in the lid tab recess 322, to prevent a person from grasping the base tab to hold down the lid when lifting the lid. A lid tab top wall 325 (FIG. 61) prevents direct access to the base tab from above. FIG. 58 shows that the lid tab 316 has corrugations in the form of upstanding (or downward projecting) ribs 326, 328 that have rib portions that extend both radially and circumferentially. The ribs stiffen the base tab and thereby make it difficult to bend down the base tab to hold it down while opening the container, so a person must first pivot up the lid tab 314.

Figure 61:
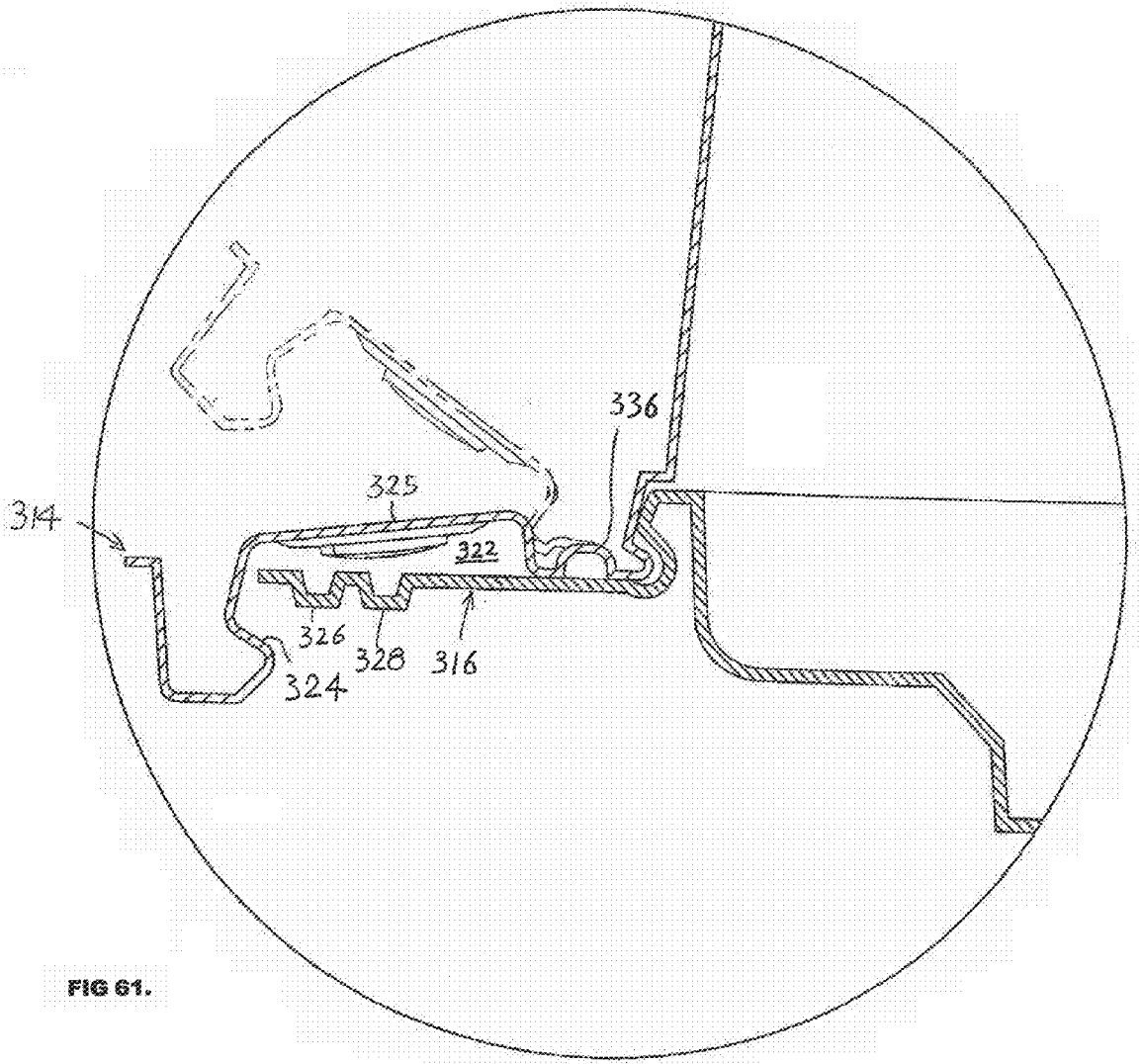
FIG. 61 is a sectional view taken on line T-T of FIG. 57.

In order to gain access to the base tab 316 (FIG. 57), a person first tears the lid tab partially free from the surrounding portion 320 of the lid, by tearing along a pair of tear line area 330, 332. When the initial opening region has been torn along the tear lines 330, 332, the lid tab 314 can pivot up about a hinge line area 336. Once the lid tab 314 has pivot up as shown in FIG. 61, the lid tab is free of the base tab 316. The person who lifted the lid tab with one hand, then can grasp or otherwise hold down the base tab 316 while pivoting open (up) the lid. Once the initial opening region has been lifted, the rest of the lid (including the latched-together portion of the lid) can be lifted up to thereby remove the lid from the base.

Applicant prefers to provide a lid tab 314 that is much wider than the base tab 216, and to orient the tear lines 330, 332 so they converge toward each other in a radially inner direction. This minimizes the circumferential width of the lid tab.

Applicant prefers to provide indicia 240, 242 (FIG. 57) on the lid tab that indicate where a finger that lies opposite the person's thumb should be placed to lift the lid tab (after tearing). The two indicia indicate that while the thumb lies under the lid tab, the index and middle fingers should lie on the indicia 240, 242. The indicia are formed by circles or other partial loops that are vacuum formed in the sheet of plastic that forms the base and/or lid.

Figure 57C:
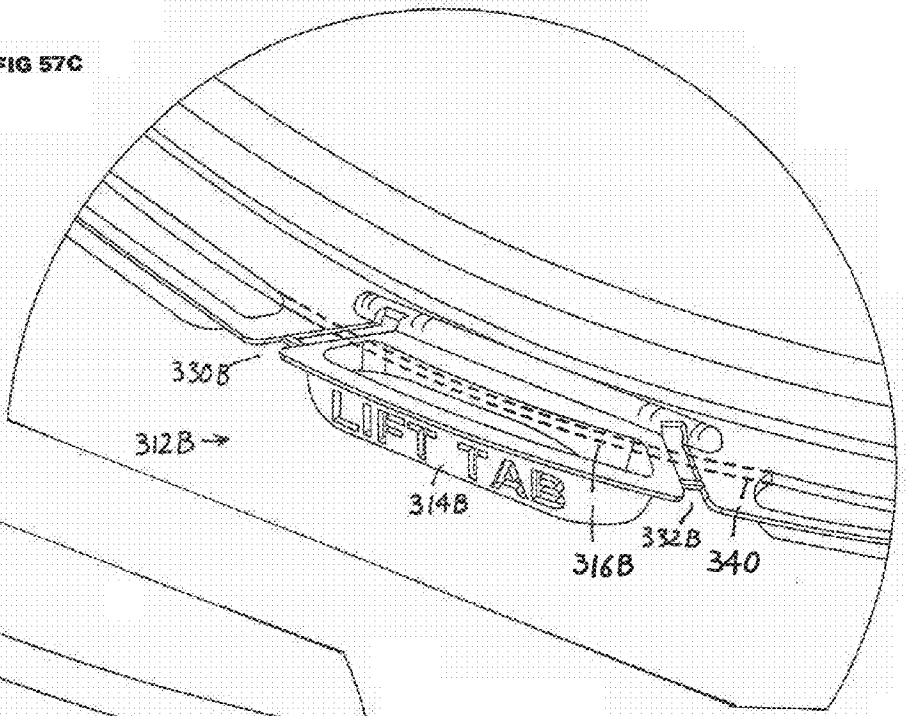
FIG. 57C is an isometric view of a variation of FIG. 57, where the base handle is a continuation of the rest of the base rim.
Figure 57B:
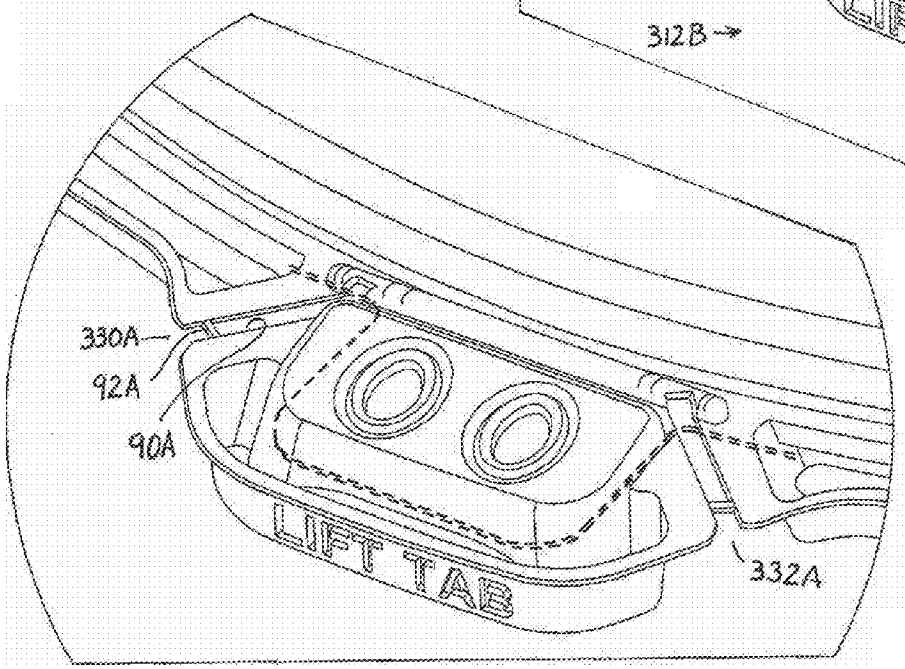
FIG. 57B is an isometric view of a variation of FIG. 57, where each tear line has a single perforation.
Figure 5B:
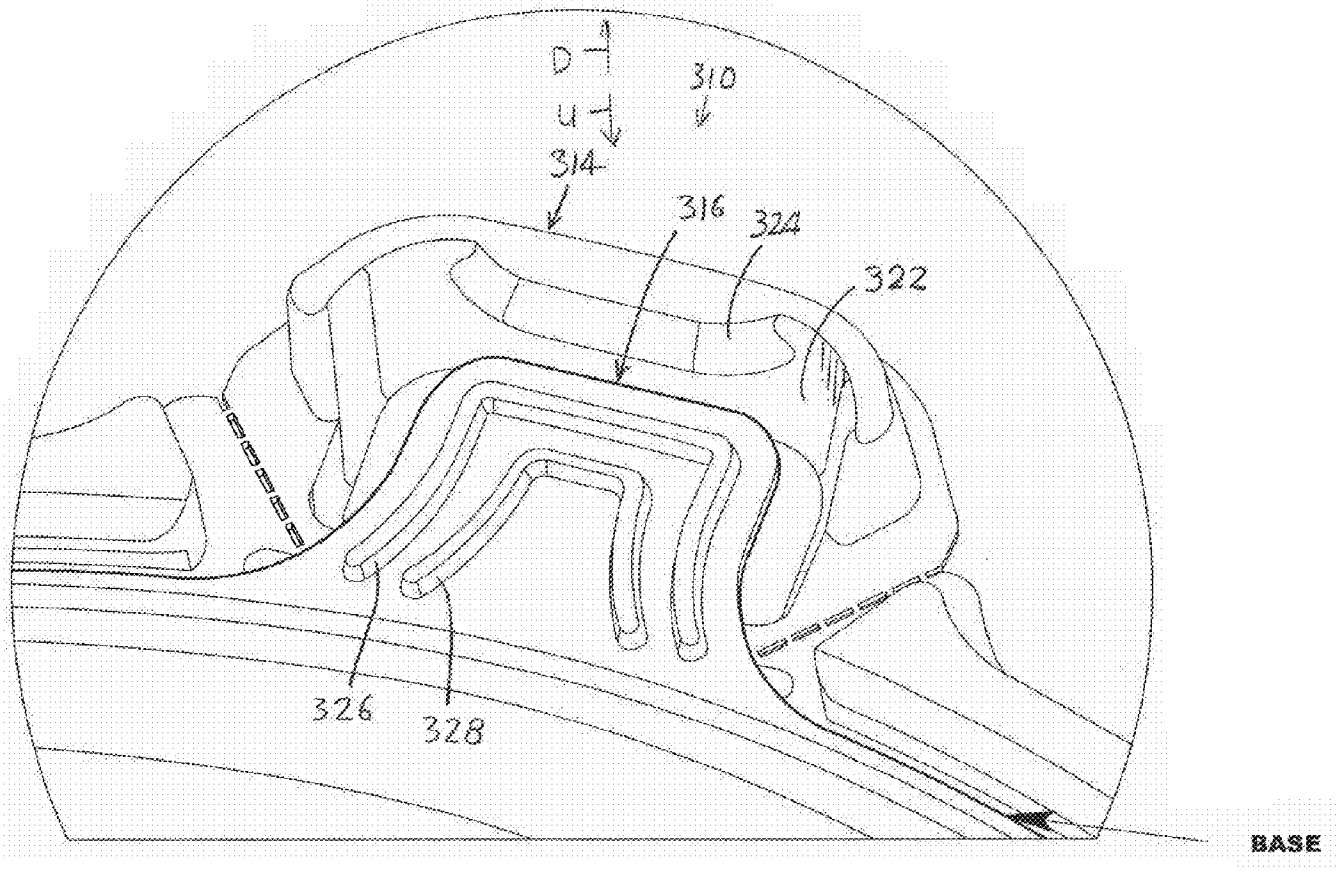
Figure 59:
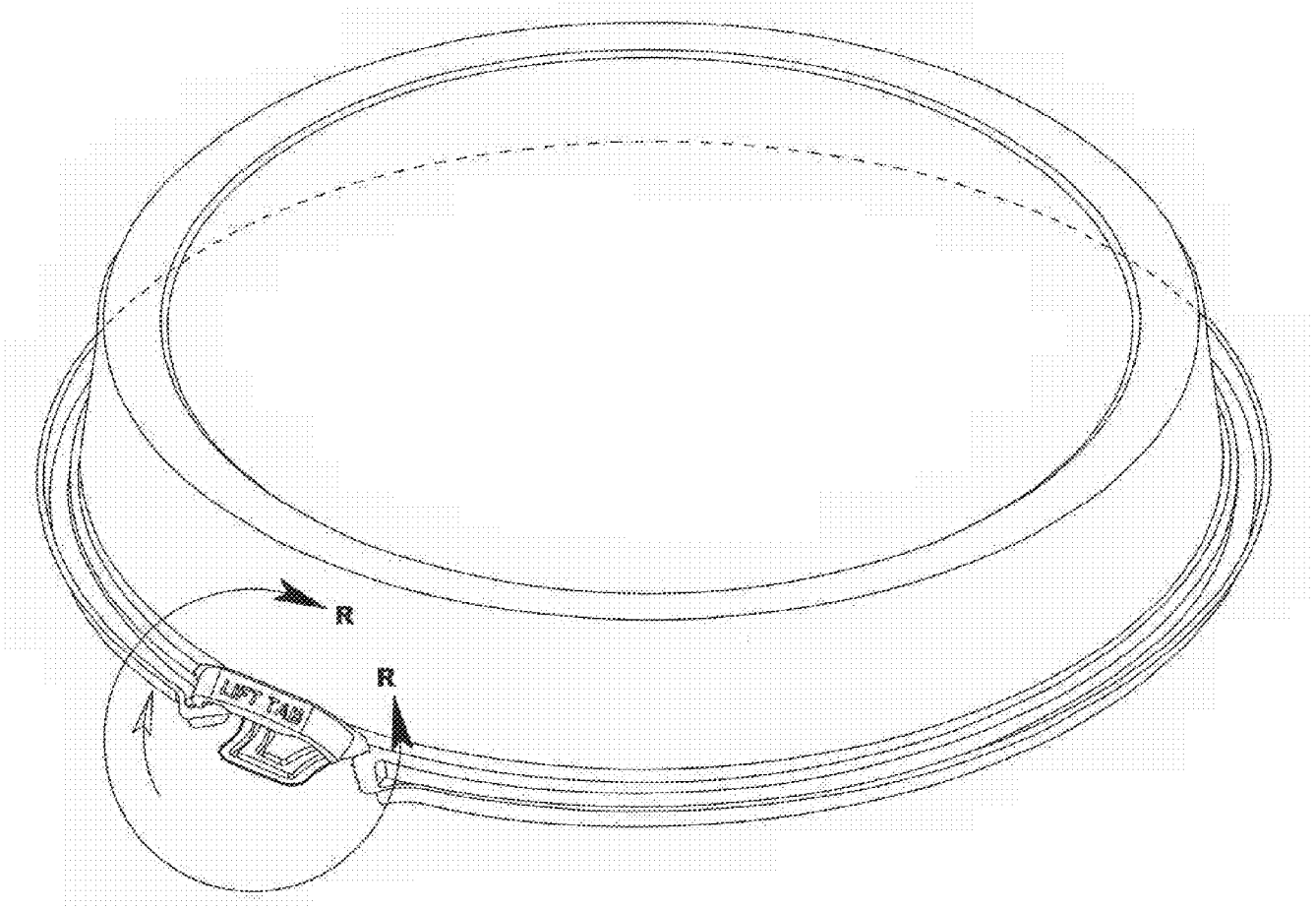
FIG. 59 is a view that is similar to FIG. 56, but with the lid tab having been torn and pivoted up.
Figure 60:
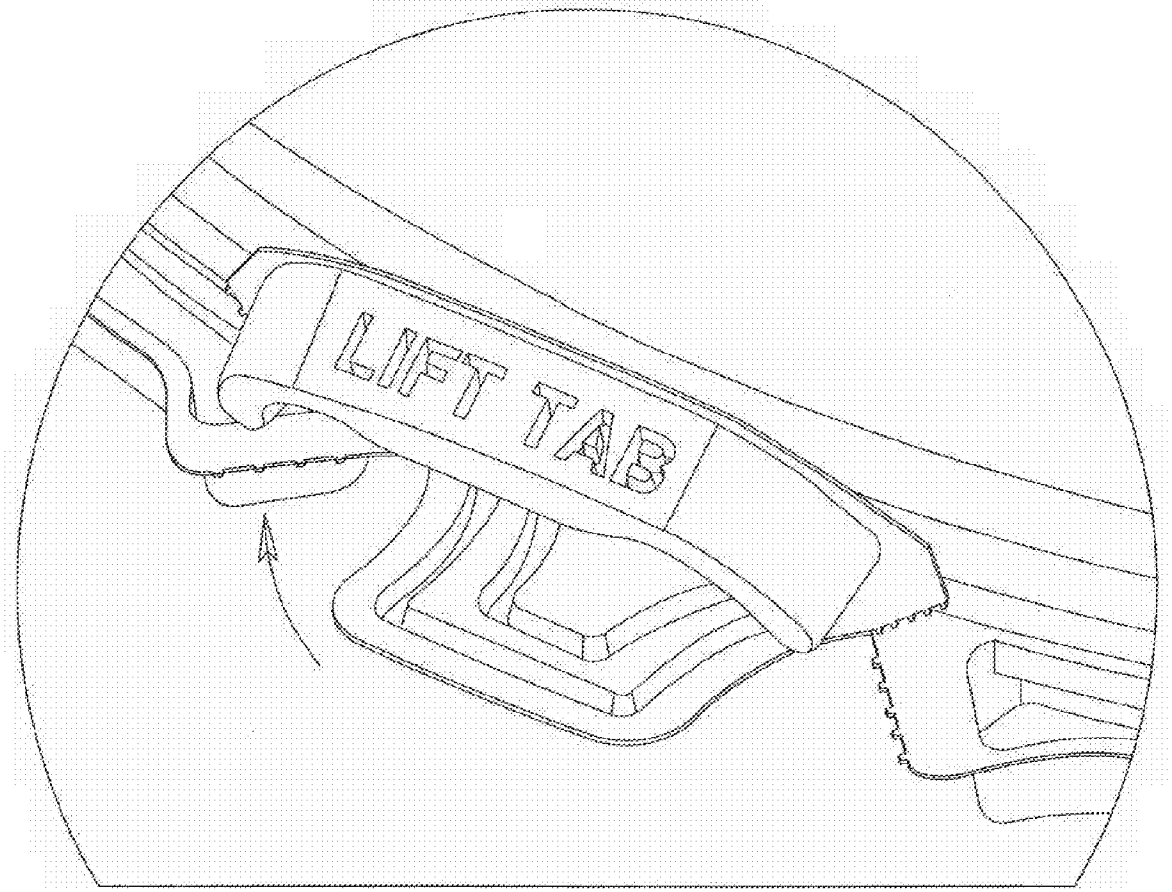
FIG. 60 is an enlarged view of area R-R of FIG. 59.

FIG. 57B shows a variation of the container wherein tear line areas 330A, 332A are modified. Instead of providing a plurality of perforations similar to 90 in FIG. 4 (and in FIG. 57) which are interrupted by a plurality connecting parts 92, applicant provides a single elongated slit or perforation 90A and provides a single connecting part 92A at the radially outer end of the perforation. The single perforation is easier to tear and still indicates tampering. The width of slot 90A should be no more than 0.5 inch.

FIG. 57C shows a container initial opening region 312B that is similar to that of FIG. 57 except that a separate distinctive base handle is not provided. Instead, the base has a base handle 316B which is part of the base rim 340 that is of a constant radius 3600 around the axis. However, the lid tab 314B extends radially inward far enough that when tear line areas 330B, 332B are torn, a person can hold down the base by holding down the base handle 316B.

Thus, the invention provides containers formed of at least one sheet of material, preferably transparent plastic, that forms a container with a lid and base that are initially opened at an initial opening region after tearing along at least one tear line. The lid and base each have tabs (one of them sometimes referred to as a tear-away part) that both must be grasped to pull apart the lid and base. In one embodiment of the invention, the base has a base lid, or tear-away part, that lies under the lid tab and prevents access to the lid tab until the base tab is torn along at least one line area. In another embodiment of the invention, the lid tab is wider than the base tab. In that container, the lid tab lies over the base tab and the lid tab conceals, or isolates the base tab to prevent it from being held down as the lid is raised. In another embodiment of the invention, the container includes a lid attachment that is installed upside-down on a lid by the lid attachment having a hook that can be installed in a lid groove.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container having base and lid elements formed of at least one sheet and having a vertical axis, said base and lid elements having latched-together portions that extend by an angle B of more than 180° around said axis and that resist separation until said base and lid elements are separated at an initial opening region that lies at a periphery of said container that is away from said latched-together portions, wherein:

at said initial opening region said base and lid elements each has a radially outwardly projecting tab that projects from a surrounding region of the base and lid elements, respectively, said tabs including a lid tab that can be grasped and pulled up and a base tab that can be grasped to be held down while the lid tab is pulled up to open the container;

a first of said tabs is a blocking tab that is joined by at least one tear line to a surrounding region of the corresponding element, and the other of said tabs is an isolated tab;

said blocking tab isolates said isolated tab by preventing a person from grasping the isolated tab until the blocking tab is torn along said at least one tear line to expose said isolated tab so it can be grasped;

said blocking tab is a lid tab extending from a major part of said lid element, said lid tab having a top wall and a bottom having a downward-opening recess defined therein;

said isolated tab is a base tab which can be received by said recess of said lid tab.

2. A container having a base and lid formed of at least one sheet and having a vertical axis, said base and lid having latched-together portions that extend by an angle B of more than 180° around said axis and that cannot be separated until said base and lid are separated at an initial opening region that lies at a periphery of said container that is away from said latched-together portions, wherein:

said base initial opening region forms a tear-away part and a surrounding region, said tear-away part connected to said surrounding region by circumferentially-spaced and elongated largely radially-extending first and second line areas and by an elongated largely circumferentially-extending third line area;

at said initial opening region said lid has a lid lift portion that can be grasped and lifted when not blocked, and said tear-away part of said base forms a blocker that extends above and closely radially outward of said lid lift portion, to block access to said lift portion until said tear-away portion is torn away along at least one of said line areas, and said base forms a lid support surface that extends radially inward of said base blocker and that supports said lid lift portion.

3. The container described in claim 2 wherein:

said third line area is a through cut, said first line area forms a tear line that can be easily torn, and said second line area forms a hinge.

4. The container described in claim 2 wherein:

said third line area forms a hinge and said first and second line areas each forms a tear line.

5. The container described in claim 2 wherein:

said first and second line areas each forms a tear line and said third line area forms a through cut.

6. The container described in claim 2 wherein:

said tear-away part of said base has a support wall that supports said lid tab, said support wall having a vertical projection forming a base locator;

said lid tab has a lid vertical projection forming a lid locator, with one of said base locator and said lid locator forming a vertical recess that receives the vertical projection of the other of said base locator and said lid locator.

7. The container described in claim 6 wherein:

said base and lid locators form snap locators that snap one into the other to resist their vertical separation.

8. The container described in claim 2 wherein:

said lid lift portion is in the form of a radially outward projecting lid tab that has a radially outer tab edge that is circumferentially narrower than said tear-away part and that has opposite tab sides;

said tear-away part of said base has a raised outer blocking rib that projects higher than said tab and that forms said blocker, with said raised outer blocking rib closely surrounding said radially outer end of said lid tab and portions of said opposite sides of said lid tab.

9. The container described in claim 8 wherein:

said base has an upwardly-extending main outer rib which extends around a majority of said axis and which has main outer rib ends that each lies opposite said blocking rib with said first and second line areas each lying between one of said blocking rib ends and one of said main rib outer ends, with each of said main outer rib ends and an adjacent end of said outer blocking rib being spaced apart from a gap between them, with each gap having a circumferential width of no more than one centimeter, whereby to resist a person inserting his/her finger through the gap to grasp the lid.

10. The container described in claim 8 wherein:

said raised outer blocking rib has an upper end with a radially-inward projecting overhang that extends radially inward to lie over said lid tab.

11. A container having a base and lid formed of at least one plastic sheet and having a vertical axis, wherein said base and lid have latched-together portions that hold together to resist lid pull-up and extend by an angle B of more than 180° around said axis, and that cannot be separated until said base and lid are separated at an initial opening region of said container where said lid is initially held down to said base but said lid can be lifted off said base after tearing a part, so as to make it evident that the container has been opened, wherein:

at said initial opening region said lid has a radially outward projecting lid tab that can be grasped to lift said lid off said base, and said base has a base blocker that extends upward above and radially outward of said lid tab to block grasping of said lid tab;

said base initial opening region forms a base tear-away part and a base surrounding region that extends circumferentially beyond opposite ends of said tear-away part and radially inward of said tear-away part;

said base tear-away part is connected to said base surrounding region by first and second line areas that extend at least partially radially and by a largely circumferentially-extending third line area;

at least one of said first and second line areas forming a tear line that is weakened so it can be torn free of said base surrounding region.

12. The container described in claim 11 wherein:

said lid tab has a radially outer edge and a pair of opposite side edges;

said blocking part comprises an upwardly-deformed part of said at least one plastic sheet that lies above the height of said lid tab and that closely surrounds said lid tab outer edge and radially outer portions of said lid tab opposite sides.

13. The container described in claim 11 wherein:

said base blocker has an overhang that lies above and vertically over said tab.

14. The container described in claim 11 including:

a lid attachment that has primarily vertical side walls forming a downwardly-opening second cavity, with said primarily vertical side walls forming a hook shaped lower rim that includes an upwardly and radially outward projector latch part with a free end;

said lid has an upwardly-opening groove with bottom, radially inner and radially outer groove walls and with said outer groove wall forming a radially inward projection forming an undercut, said hook shaped lower end lying in said groove with said latch part free end lying directly under said radially inward projection.

15. The container described in claim 11, wherein:

said lid tab and said base each has a vertical projection that forms a locator that closely fits one into the other.

16. The container described in claim 15, wherein:

a first of said locators forms an undercut recess with undercuts, and a second of said locators form a pair of projections that lie in said undercuts.

17. A container having a base and a lid formed of at least one sheet and having a vertical axis, said lid being openable on said base to gain access to a first food on said base, and said lid having a top;

a lid attachment that has primarily vertical side walls forming a downwardly-opening cavity for holding a second food that rests on said lid top, with said primarily vertical side walls having a lower end forming a latch part;

said lid has groove walls forming an upward-opening undercut groove;

said latch part of said side wall lower ends lies in said undercut groove and is latched to walls of said undercut groove.

18. The container described in claim 17 wherein:

said lower end of said lid attachment side walls form a hook that includes radially inner and outer hook sides and a bottom wall that connects lower ends of said inner and outer hook sides, said radially outer hook side extending at an upward and radially outward incline;

said groove walls include a radially outer wall with a radially inward projecting projection, with said outer hook side lying under said projection.

19. The container described in claim 17 wherein said base and lid have latched-together portions that extend by an angle B of more than 180° around said axis and that cannot be separated until said base and lid are separated around an angle A of an initial opening region and wherein:

said lower end of said lid attachment side walls form a hook that includes radially inner and outer hook sides and a bottom wall that connects lower ends of said inner and outer hook sides, said radially outer hook side extending at an upward and radially outward incline;

said groove walls include a radially outer wall with a radially inward projection, with said outer hook side having an end that lies under and against said radially outer wall projection around at least part of said angle B, but said free end not lying against said radially outer wall along said angle A of said initial opening region.

20. A method for constructing a container, comprising:

constructing a lid and a base to define said container having a vertical axis;

providing the lid and the base with latched together portions that extend by an angle B of more than 180° around the vertical axis and that resist separation until the base and lid are separated at an initial opening region that lies at a periphery of the container that is away from the latched-together portions; and forming said base with a radially outward extending base tab and said lid with a radially outward extending lid tab;

wherein one of said radially outward extending base tab or said radially outward extending lid tab comprises a blocking tab joined by at least one tear line to a surrounding region of the corresponding base or lid, respectively, and the other of said radially, outward extending base tab or said radially outward extending lid tab comprises an isolated tab, wherein the blocking tab prevents the isolated tab from being grasped until the blocking tab is torn along the at least one tear line to expose the isolated tab;

said blocking tab comprises a tab having circumferentially opposite sides connected by radially elongated line areas to the surrounding region of said corresponding base or lid, respectively, to prevent said blocking tab from bending so as to expose said isolated tab; and said at least one tear line comprises line areas that can be torn to allow said blocking tab to be pivoted and expose said isolated tab.

21. The method described in claim 20, wherein:

said radially outward extending lid tab comprises said isolated tab extending from a major part of the lid;

said radially outward extending base tab comprises said blocking tab extending above and radially outward from the lid tab;

said radially outward extending lid tab comprises a radially outer tab edge that is circumferentially narrower than the base tab; and said radially outward extending base tab comprises a raised outer blocking rib that projects higher than the lid tab and that forms a blocker, wherein the outer blocking rib closely surrounds the radially outer tab edge.

22. The method described in claim 20, wherein:

said radially outward extending lid tab comprises said blocking tab extending from a major part of the lid, the lid tab having a top wall and a downward-opening recess; and said radially outward extending base tab comprises said isolated tab extending from the base that lies in the recess of the lid tab.

23. The method described in claim 20, wherein said blocking tab joined by at least one tear line to a surrounding region of the base or lid, respectively, comprises a blocking tab that is joined to the surrounding region of the corresponding base or lid, respectively, by a first line area, a second line area, and a third line area, wherein the first and second line areas are spaced circumferentially and extend largely radially, and said third line area extends largely circumferentially.

24. The method described in claim 23, wherein the third line area is a through cut, the first line area forms a tear line, and the second line area forms a hinge.

25. The method described in claim 23, wherein the third line area forms a hinge, the first line area forms a tear line, and the second line area forms a tear line.

26. The method described in claim 23, wherein the third line area is a through cut, the first line area forms a tear line, and the second line area forms a tear line.

27. A method for constructing a container, comprising:

constructing a lid and a base to define said container having a vertical axis;

providing the lid and the base with latched together portions that extend by an angle B of more than 180° around the vertical axis and that resist separation until the base and lid are separated at an initial opening region that lies at a periphery of the container that is away from the latched-together portions; and forming said base with a radially outward extending base tab and said lid with a radially outward extending lid tab;

wherein one of said radially outward extending base tab or said radially outward extending lid tab comprises a blocking tab joined by at least one tear line to a surrounding region of the corresponding base or lid, respectively, and the other of said radially outward extending base tab or said radially outward extending lid tab comprises an isolated tab, wherein the blocking tab prevents the isolated tab from being grasped until the blocking tab is torn along the at least one tear line to expose the isolated tab;

said radially outward extending lid tab comprises said isolated tab extending from a major part of the lid;

said radially outward extending base tab comprises said blocking tab extending above and radially outward from the lid tab;

said radially outward extending lid tab comprises a radially outer tab edge that is circumferentially narrower than the base tab; and said radially outward extending base tab comprises a raised outer blocking rib that projects higher than the lid tab and that forms a blocker, wherein the outer blocking rib closely surrounds the radially outer tab edge.

28. A method for constructing a container, comprising:

constructing a lid and a base to define said container having a vertical axis;

providing the lid and the base with latched together portions that extend by an angle B of more than 180° around the vertical axis and that resist separation until the base and lid are separated at an initial opening region that lies at a periphery of the container that is away from the latched-together portions; and forming said base with a radially outward extending base tab and said lid with a radially outward extending lid tab;

wherein one of said radially outward extending base tab or said radially outward extending lid tab comprises a blocking tab joined by at least one tear line to a surrounding region of the corresponding base or lid, respectively, and the other of said radially outward extending base tab or said radially outward extending lid tab comprises an isolated tab, wherein the blocking tab prevents the isolated tab from being grasped until the blocking tab is torn along the at least one tear line to expose the isolated tab;

said radially outward extending lid tab comprises said blocking tab extending from a major part of the lid, the lid tab having a top wall and a downward-opening recess; and said radially outward extending base tab comprises said isolated tab extending from the base that lies in the recess of the lid tab.

29. A method for constructing a container, comprising:

constructing a lid and a base to define said container having a vertical axis;

providing the lid and the base with latched together portions that extend by an angle B of more than 180° around the vertical axis and that resist separation until the base and lid are separated at an initial opening region that lies at a periphery of the container that is away from the latched-together portions; and forming said base with a radially outward extending base tab and said lid with a radially outward extending lid tab;

wherein one of said radially outward extending base tab or said radially outward extending lid tab comprises a blocking tab joined by at least one tear line to a surrounding region of the corresponding base or lid, respectively, and the other of said radially outward extending base tab or said radially outward extending lid tab comprises an isolated tab, wherein the blocking tab prevents the isolated tab from being grasped until the blocking tab is torn along the at least one tear line to expose the isolated tab;

wherein said blocking tab joined by at least one tear line to a surrounding region of the base or lid, respectively, comprises a blocking tab that is joined to the surrounding region of the corresponding base or lid, respectively, by a first line area, a second line area, and a third line area, wherein the first and second line areas are spaced circumferentially and extend largely radially, and said third line area extends largely circumferentially.

* * * * *